US008073368B2

(12) United States Patent
Iwata et al.

(10) Patent No.: US 8,073,368 B2
(45) Date of Patent: Dec. 6, 2011

(54) DEVELOPMENT DEVICE AND IMAGE FORMING APPARATUS

(75) Inventors: Nobuo Iwata, Sagamihara (JP); Junichi Matsumoto, Sagamihara (JP); Natsumi Katoh, Atsugi (JP); Tomoya Ohmura, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 251 days.

(21) Appl. No.: 12/547,111

(22) Filed: Aug. 25, 2009

(65) Prior Publication Data

US 2010/0061774 A1 Mar. 11, 2010

(30) Foreign Application Priority Data

Sep. 11, 2008 (JP) ..... 2008-233835
Feb. 13, 2009 (JP) ..... 2009-031934

(51) Int. Cl.
*G03G 15/09* (2006.01)

(52) U.S. Cl. ..... 399/272

(58) Field of Classification Search ..... 399/30, 399/81, 93, 98, 106, 120, 253, 254, 258, 399/259, 262, 263, 272, 359, 92, 274, 281
See application file for complete search history.

(56) References Cited

U.S. PATENT DOCUMENTS 3,654,901 A * 4/1972 Donohue et al. ..... 399/359
4,373,468 A * 2/1983 Suda et al. ..... 399/103
5,202,730 A * 4/1993 Fuji et al. ..... 399/270
5,414,497 A * 5/1995 Tsuchiya et al. ..... 399/272
5,848,326 A * 12/1998 Komuro et al. ..... 399/98
5,909,609 A * 6/1999 Yahata et al. ..... 399/258
5,950,055 A * 9/1999 Yahata et al. ..... 399/252
6,201,941 B1 * 3/2001 Kasahara et al. ..... 399/258
6,678,492 B1 * 1/2004 Terazawa et al. ..... 399/258
6,785,496 B2 * 8/2004 Iwata et al. ..... 399/258
7,043,179 B2 * 5/2006 Matsumoto et al. ..... 399/258
7,522,857 B2 * 4/2009 Hasegawa et al. ..... 399/109
7,792,472 B2 * 9/2010 Ichikawa et al. ..... 399/267
7,835,653 B2 * 11/2010 Katoh et al. ..... 399/30
7,894,753 B2 * 2/2011 Kasahara et al. ..... 399/262
7,904,006 B2 * 3/2011 Muramatsu ..... 399/262
2002/0009310 A1 * 1/2002 Kabumoto et al. ..... 399/258
2003/0012586 A1 * 1/2003 Iwata et al. ..... 399/258
2003/0156859 A1 8/2003 Tamai
2004/0009015 A1 * 1/2004 Fujimori et al. ..... 399/258
2005/0013634 A1 * 1/2005 Fujii et al. ..... 399/258
2005/0041998 A1 * 2/2005 Fujii et al. ..... 399/258
2005/0191095 A1 * 9/2005 Aoki et al. ..... 399/281
2006/0213573 A1 * 9/2006 Amano ..... 141/65

(Continued)

FOREIGN PATENT DOCUMENTS

JP 60-126669 7/1985

(Continued)

*Primary Examiner* — Kiho Kim
(74) *Attorney, Agent, or Firm* — Oblon, Spivak, McClelland, Maier & Neustadt, L.L.P.

(57) ABSTRACT

A development device includes a developer carrier, and a developer conveyance path. The developer carrier carries and conveys developer having a magnetic property. The developer carrier includes a plurality of magnetic poles provided inside the development carrier. The developer conveyance path is provided above the developer carrier and conveys the developer by a flow of air such that the developer is conveyed parallel to the developer carrier. The developer conveyance path is provided with a first developer outlet disposed above the developer carrier and open along a direction of conveyance of the developer to discharge the developer to the outside of the developer conveyance path to directly supply the developer to the developer carrier.

20 Claims, 19 Drawing Sheets

U.S. PATENT DOCUMENTS

| | | | | |
|---|---|---|---|---|
| 2007/0053721 | A1* | 3/2007 | Matsumoto et al. | 399/258 |
| 2007/0053723 | A1 | 3/2007 | Iwata et al. | |
| 2007/0154242 | A1 | 7/2007 | Matsumoto et al. | |
| 2007/0166079 | A1* | 7/2007 | Ichikawa et al. | 399/254 |
| 2007/0264053 | A1 | 11/2007 | Iwata et al. | |
| 2007/0274740 | A1* | 11/2007 | Katoh et al. | 399/254 |
| 2007/0280742 | A1* | 12/2007 | Matsumoto et al. | 399/258 |
| 2008/0226349 | A1 | 9/2008 | Iwata et al. | |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0123174 | A1 | 5/2009 | Iwata et al. | |

FOREIGN PATENT DOCUMENTS

| | | |
|---|---|---|
| JP | 4-198966 | 7/1992 |
| JP | 5-21082 | 5/1993 |
| JP | 7-219347 | 8/1995 |
| JP | 7-225515 | 8/1995 |
| JP | 2007-187935 | 7/2007 |

* cited by examiner

FIG. 23A
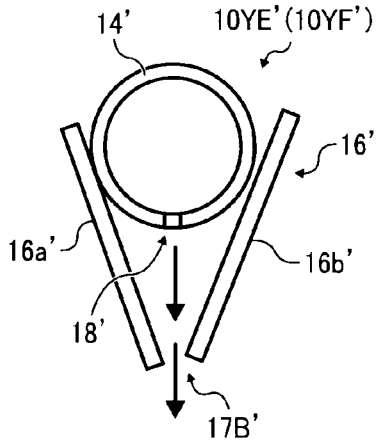
FIG. 23B
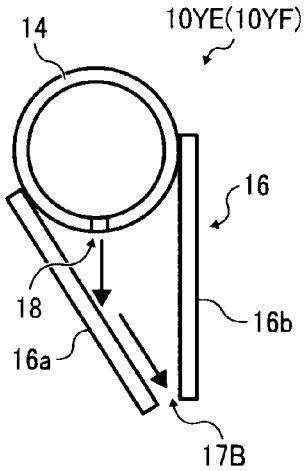
FIG. 24
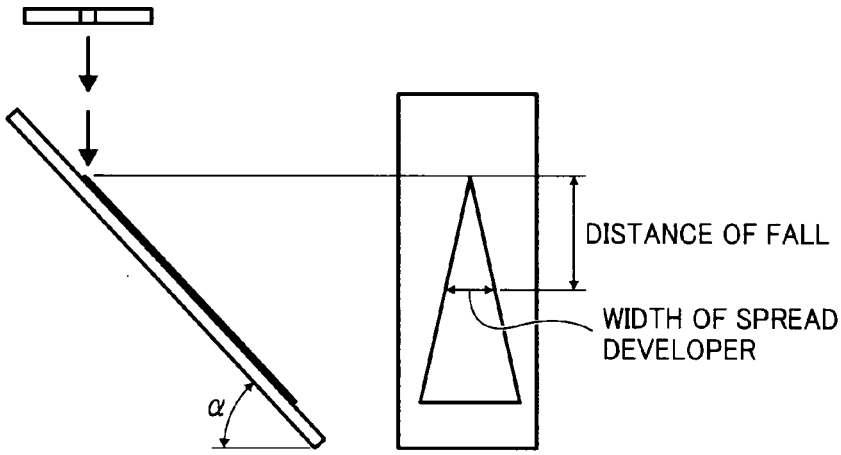
FIG. 25
| | | DISTANCE | | |
|---|---|---|---|---|
| | | 30mm | 60mm | 90mm |
| ANGLE OF SLOPE | 30 DEGREES | 18mm | 26mm | 50mm |
| | 40 DEGREES | 12mm | 18mm | 18mm |
| | 60 DEGREES | 18mm | 18mm | 18mm |

DEVELOPMENT DEVICE AND IMAGE FORMING APPARATUS

CROSS-REFERENCE TO RELATED APPLICATIONS

The present application is based on and claims priority from Japanese Patent Application Nos. 2008-233835, filed on Sep. 11, 2008, and 2009-031934, filed on Feb. 13, 2009 in the Japan Patent Office, the entire contents of each of which are hereby incorporated herein by reference.

BACKGROUND OF THE INVENTION

1. Field of the Invention

Exemplary aspects of the present invention relate to a development device and an image forming apparatus, and more particularly, to a development device and an image forming apparatus for stably and efficiently supplying developer to a developer carrier.

2. Description of the Related Art

Related-art image forming apparatuses, such as copiers, facsimile machines, printers, and multifunction devices having at least one of copying, printing, scanning, and facsimile functions, typically form a toner image on a recording material (e.g., a sheet) based on image data using electrophotography.

For example, when an electrostatic latent image is formed on a surface of a photoconductor, serving as an image carrier, a development device develops the electrostatic latent image with a developer (e.g., a two-component developer) into a visible toner image. The two-component developer includes toner and carrier. The development device stirs and disperses the toner and the carrier within the development device to charge the toner triboelectrically. Insufficient dispersal and charging of the toner may cause the toner to scatter from the development device, thereby generating a faulty image with background soiling or the like.

In particular, high-speed image forming apparatuses quickly circulate developer inside the development device, and are prone to causing insufficient toner charging. Increasing the capacity of the development device allows the toner to disperse more easily and charge sufficiently, but at the cost of an increase in the size of the development device and a concomitant increase in the overall size of the image forming apparatus.

To solve the above-described problem, various approaches have been taken.

For example, one related-art development device using two-component developer includes a development member and a developer agitation member separated from each other but connected by a developer circulation member. Another related-art development device uses a screw pump to transfer developer.

Such development devices include a developer carrier that holds developer, two screws to circulate the developer, a developer controller (such as a doctor blade), and the like. One screw supplies the developer to the development roller and the other screw collects the developer after development for possible reuse.

However, such circulation of the developer using screws tends to create an uneven supply of developer to the development roller, resulting in faulty images with uneven toner density.

Accordingly, there is a need for a technology capable of providing a development device for stably and effectively supplying developer to a developer carrier, and an image forming apparatus incorporating the development device for stably forming high-quality images.

BRIEF SUMMARY OF THE INVENTION

This specification describes a development device according to illustrative embodiments of the present invention. In one illustrative embodiment of the present invention, the development device includes a developer carrier and a developer conveyance path. The developer carrier is configured to carry and convey developer having a magnetic property. The developer carrier includes a plurality of magnetic poles provided inside the development carrier. The developer conveyance path is provided above the developer carrier and configured to convey the developer by a flow of air such that the developer is conveyed parallel to the developer carrier. The developer conveyance path is provided with a first developer outlet disposed above the developer carrier and open along a direction of conveyance of the developer to discharge the developer to the outside of the developer conveyance path, so that the developer directly drops and supplied to the developer carrier.

This specification further describes an image forming apparatus according to illustrative embodiments of the present invention. In a further illustrative embodiment of the present invention, the image forming apparatus includes a latent image forming device including an image carrier and a development device. The latent image forming device is configured to form an electrostatic latent image. The image carrier is configured to carry the electrostatic latent image. The development device is configured to develop the electrostatic latent image into a visible image and includes a developer carrier and a developer conveyance path as described above.

BRIEF DESCRIPTION OF THE DRAWINGS

A more complete appreciation of the invention and the many attendant advantages thereof will be more readily obtained as the same becomes better understood by reference to the following detailed description when considered in connection with the accompanying drawings, wherein:

FIG. 23A is a schematic sectional view of a related-art developer conveyer and a related-art developer holder;

FIG. 23B is a schematic sectional view of the developer conveyer and the developer holder of the development member shown in FIG. 20;

FIG. 24 is an illustration of an experiment for obtaining a distance between each opening of the developer conveyer shown in FIG. 23B;

FIG. 25 is a table of widths of developer falling down on a wall inclining at an angle of $\alpha$;

DETAILED DESCRIPTION OF THE INVENTION

Figure 1:
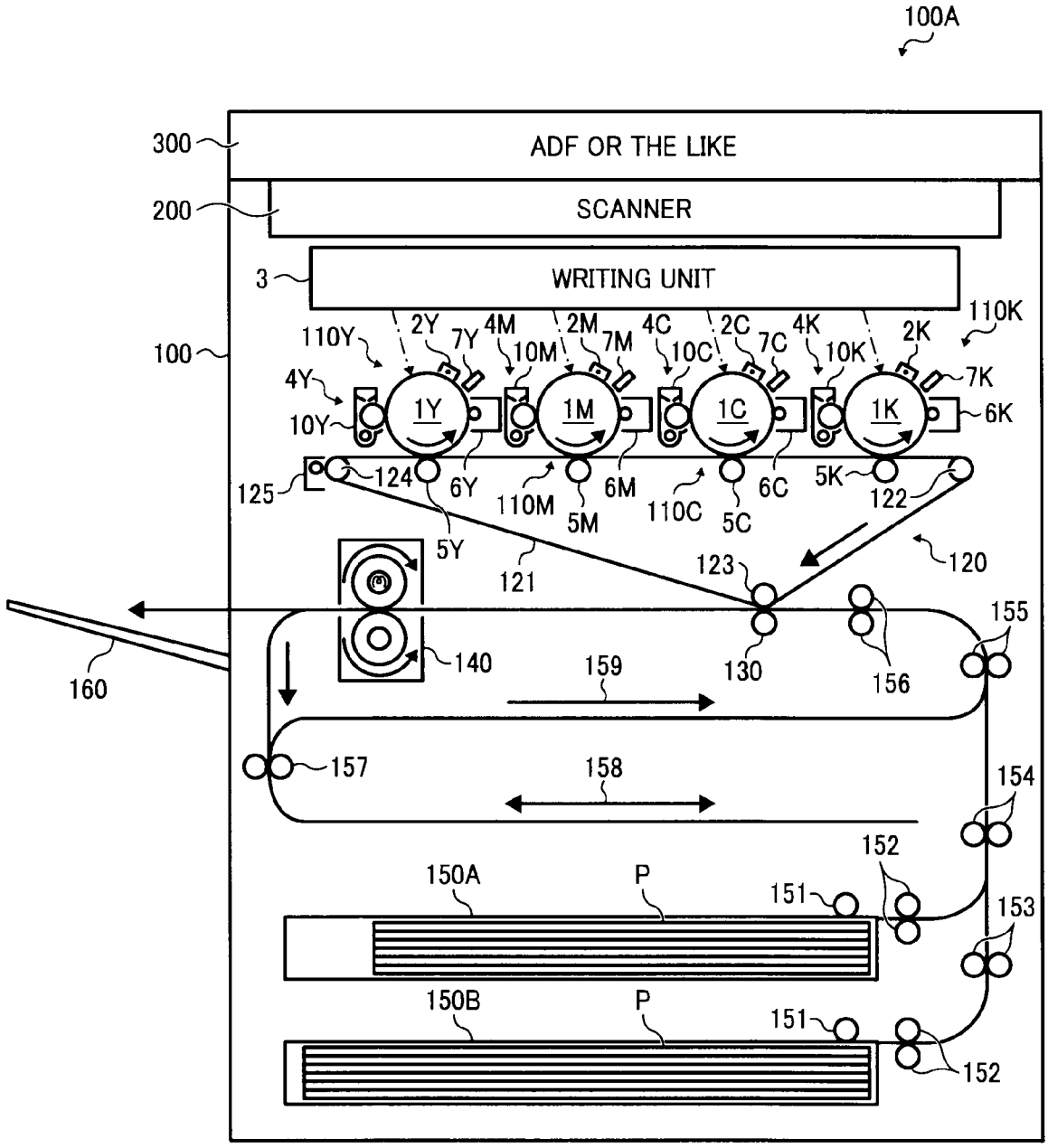
FIG. 1 is a schematic sectional view of an image forming apparatus according to an illustrative embodiment of the present invention.

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, in particular to FIG. 1, a tandem-type full color image forming apparatus 100A using an intermediate transfer method according to an illustrative embodiment of the present invention is described.

FIG. 1 is a schematic view of the image forming apparatus 100A. The image forming apparatus 100A includes an image forming apparatus body 100, a scanner 200, and an ADF (automatic document feeder) 300. The image forming apparatus body 100 includes image forming units 110Y, 110M, 110C, and 110K, an intermediate transfer unit 120, a writing unit 3, a secondary transfer roller 130, a fixing unit 140, a plurality of paper trays 150A and 150B, pickup rollers 151, and feed rollers 152, conveyance rollers 153, 154, and 155, registration rollers 156, a switch back roller 157, a sheet inverting portion 158, a re-feed path 159, and an output tray 160.

The image forming units 110Y, 110M, 110C, and 110K include photoconductors 1Y, 1M, 1C, and 1K, charging devices 2Y, 2M, 2C, and 2K, development devices 4Y, 4M, 4C, and 4K, primary transfer rollers 5Y, 5M, 5C, and 5K, photoconductor cleaners 6Y, 6M, 6C, and 6K, and QL (quenching lamps) 7Y, 7M, 7C, and 7K, respectively. The development devices 4Y, 4M, 4C, and 4K include development members 10Y, 10M, 10C, and 10K, respectively. The intermediate transfer unit 120 includes an intermediate transfer member 121, an intermediate transfer belt cleaner 125, and a plurality of rollers 122, 123, and 124.

The scanner 200 is provided in an upper portion of the image forming apparatus body 100, and reads an image of an original document. The openably closable ADF 300 is provided above the scanner 200, and feeds an original document to an exposure glass of the scanner 200.

The image forming units 110Y, 110M, 110C, and 110K, serving as latent image forming devices, form yellow, magenta, cyan, and black toner images, and have the same structure except that they form different color toner images. The charging devices 2Y, 2M, 2C, and 2K, for example, chargers, charging rollers, or the like, are provided around the photoconductors 1Y, 1M, 1C, and 1K, serving as image carriers. The photoconductor cleaners 6Y, 6M, 6C, and 6K cleans respective surfaces of the photoconductors 1Y, 1M, 1C, and 1K. The QL (quenching lamps) 7Y, 7M, 7C, and 7K discharge the respective surfaces of the photoconductors 1Y, 1M, 1C, and 1K.

The writing unit 3 is provided above the image forming units 110Y, 110M, 110C, and 110K, and directs a writing beam corresponding to respective color toner images to each of the photoconductors 1Y, 1M, 1C, and 1K. For example, the writing unit 3 is a writing device of an optical scanning method including a laser light source, an optical deflector, and a scanning optical system, a writing device including a LED (light emitting diode) array using imaging optics, or the like.

The intermediate transfer unit 120 is provided below the image forming units 110Y, 110M, 110C, and 110K. The endless belt-shaped intermediate transfer member 121, hereinafter referred to as the intermediate transfer belt 121, is wrapped around the plurality of rollers 122, 123, and 124. Respective color toner images formed on the photoconductors 1Y, 1M, 1C, and 1K are primarily transferred to the intermediate transfer belt 121.

The secondary transfer roller 130 is provided below the intermediate transfer unit 120, and secondarily transfers the respective color toner images formed on the intermediate transfer belt 121 to a recording medium, for example, a recording sheet.

A paper feed device is provided in a lower portion of the image forming apparatus body 100. The plurality of paper trays 150A and 150B are detachably attachable to the feed device, and store a recording sheet P as a recoding medium having different sides. The pickup rollers 151 and the feed rollers 152 are provided in the feed device, and sequentially feed a recording sheet P from the paper trays 150A and 150B. When fed from the feed device, the recording sheet P is conveyed upwards by the conveyance rollers 153, 154, and 155 and properly fed to the secondary transfer roller 130 by the registration rollers 156.

The fixing unit 140 is provided downstream from the secondary transfer roller 130 in a direction of conveyance of the recording sheet P, and fixes a toner image transferred to the recording sheet P. A branch path is provided downstream from the fixing unit 140, and switches a direction of conveyance of the recording sheet P according to a print mode. One path separated from the branch path leads to a discharge path for discharging a recording sheet P to the discharge tray 160, whereas the other path leads to the sheet inverting portion 158 and the re-feed path 159 used for duplex printing.

The image forming apparatus 100A may be a copier, a facsimile machine, a printer, a plotter, a multifunction printer having at least one of copying, printing, scanning, and facsimile functions, or the like, and a user can switch between the copying, printing, scanning, and facsimile functions, or the like, using a key provided in a controller.

According to this illustrative embodiment, the image forming apparatus 100A is a tandem-type full color image forming apparatus using an intermediate transfer method in which the image forming units 110Y, 110M, 110C, and 110K are provided side by side along the intermediate transfer unit 120. Alternatively, the image forming apparatus 100A may use a tandem-type direct transfer method or one drum type intermediate transfer method.

According to this illustrative embodiment, the image forming apparatus 100A forms a full color toner image by superimposing yellow, magenta, cyan, and black toner images on each other on the intermediate transfer belt 121. However, it is to be noted that the image forming apparatus 100A is not limited to the full color image forming apparatus and may form a color and/or monochrome image using a single image forming device.

When a command to start printing is input from the controller, the photoconductors 1Y, 1M, 1C, and 1K, the rollers of each unit around the photoconductors 1Y, 1M, 1C, and 1K, a driving roller of the intermediate transfer belt 121, and each roller provided in the feed and conveyance path or the like start rotating at predetermined timing, so that the paper tray 150A (or 150B) starts feeding a recording sheet P with a selected size. When charged with a uniform electrical potential by the charging devices 2Y, 2M, 2C, and 2K, the respective surfaces of the photoconductors 1Y, 1M, 1C, and 1K are exposed to the writing beam emitted from the writing unit 3 according to image data of respective color. It is to be noted that an electrical potential pattern after exposure is called an electrostatic latent image. When the development members 10Y, 10M, 10C, and 10K of the development devices 4Y, 4M, 4C, and 4K supply respective color toner to each surface of the photoconductors 1Y, 1M, 1C, and 1K, the electrostatic latent images carried by the photoconductors 1Y, 1M, 1C, and 1K are developed into a visible toner image with a specific color.

Accordingly, the yellow, magenta, cyan, and black toner images are developed on the photoconductors 1Y, 1M, 1C, and 1K in the order defined based on a system used in the image forming apparatus 100A, respectively. The respective toner images developed on the photoconductors 1Y, 1M, 1C, and 1K are primarily transferred onto the primary transfer belt 121 at a contact point between the intermediate transfer belt 121 and each of the photoconductors 1Y, 1M, 1C, and 1K due to a primary transfer bias and a pressing force applied to the primary transfer roller 5Y, 5M, 5C, and 5K opposing the photoconductors 1Y, 1M, 1C, and 1K. When the respective color toner images are sequentially primarily transferred onto the intermediate transfer belt 121, a full color toner image is formed on the intermediate transfer belt 121. Then, the secondary transfer roller 130 properly secondarily transfers the full color toner image onto a recording sheet P conveyed by the registration rollers 156 with a secondary transfer bias and a pressing force applied to the secondary transfer roller 130.

When the recording sheet P bearing the full color toner image passes the fixing unit 140, the toner image is fixed to a surface of the recording sheet P by heat and pressure. In single-sided printing, the recording sheet P is conveyed through the branch path and discharged to the discharge tray 160. In duplex printing, the recording sheet P is conveyed to the sheet inverting portion 158 via the switch back roller 157. Then, the switch back roller 157 turns the recording sheet P in the opposite direction, so that the sheet P moves out of the sheet inverting portion 158 from a distal end of the sheet P, which is called switching back, thereby inverting the sheet P. The inverted recording sheet P does not return to the fixing unit 140 and passes through the re-feed path 159, and return to the original feeding path. Then, the toner image is transferred onto a back side of the recording sheet P as in printing on a front side of the sheet, conveyed through the fixing unit 140 and discharged to the discharge tray 160, which is called duplex printing.

After the respective photoconductors 1Y, 1M, 1C, and 1K pass the primary transfer rollers 5Y, 5M, 5C, and 5K, the photoconductor cleaners 6Y, 6M, 6C, and 6K including a blade, a brush, or the like remove residual toner remaining on each surface of the respective photoconductors 1Y, 1M, 1C, and 1K. Then, the QL (quenching lamps) 7Y, 7M, 7C, and 7K uniformly discharge the respective surfaces of the photoconductors 1Y, 1M, 1C, and 1K, so as to prepare for charging for subsequent image formation. Similarly, after the intermediate transfer belt 121 passes the secondary transfer roller 130, the intermediate transfer belt cleaner 125 including a blade, a brush, or the like removes residual toner remaining on the surface of the intermediate transfer belt 121, thereby preparing for transferring a subsequent toner image. By repetition of such operation, single-sided printing or duplex printing is performed.

Figure 2:
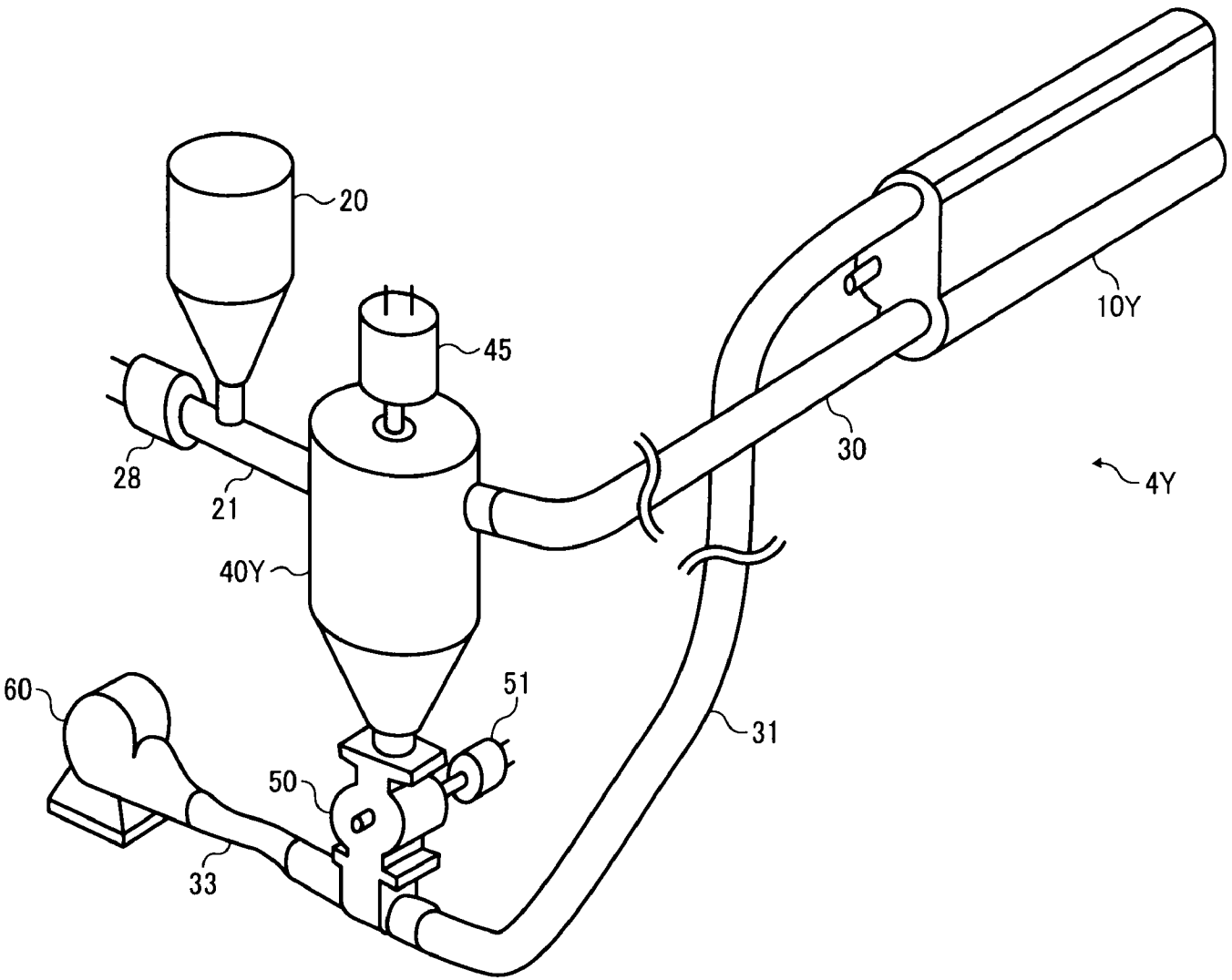
FIG. 2 is a schematic perspective view of a development device included in the image forming apparatus shown in FIG. 1.
Figure 3:
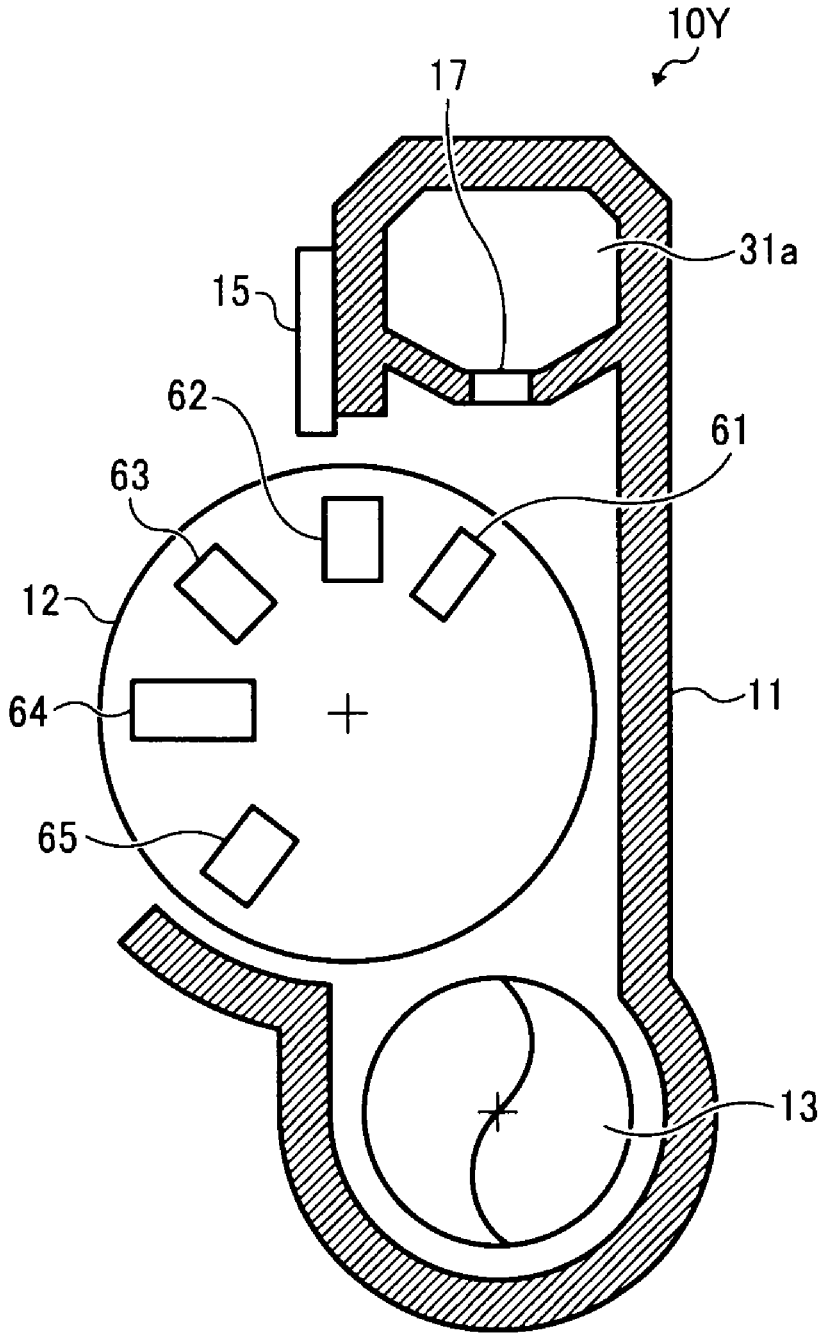
FIG. 3 is a development member included in the development device shown in FIG. 2.

Referring to FIGS. 2 and 3, a description is now given of a structure of the development device 4Y. FIG. 2 is a schematic perspective view of the development device 4Y. The other development devices 4M, 4C, and 4K have the same structure as that of the development device 4Y. FIG. 3 is a schematic sectional view of the development member 10Y.

The development device 4Y includes the development member 10Y, a developer agitation member 40Y, developer transfer members 30 and 31, a toner container 20, a rotary feeder 50, an airflow generator 60, a tube 33, a toner supply path 21, motors 45, 28, and 51.

The development member 10Y is separate from the developer agitation member 40Y, and includes a developer carrier, described later. The developer agitation member 40Y stores and agitates two-component developer including toner and magnetic carrier. Developer circulates through the development device 10Y and the developer agitation member 40Y. The developer transfer member 31, serving as a first developer transfer member, supplies developer from the developer agitation member 40Y to the development member 10Y, and the developer transfer member 30, serving as a second developer transfer member, returns developer collected by a collection path of the development member 10Y to the developer agitation member 40Y, thereby separating the development member 10Y from the developer agitation member 40Y, so that the developer 10Y can be made more compact as well as and allowing a degree of flexibility in the layout of the developer 10Y. The developer agitation member 40Y and the toner container 20 supplying toner to the developer agitation member 40Y can utilize any appropriate empty space inside the image forming apparatus 100A, thereby enabling the image forming apparatus 100A to be made more compact.

As described above, FIG. 3 is a schematic sectional view of the development member 10Y. The development member 10Y includes a casing 11, a development roller 12, a developer conveyance path 31*a*, a collection screw 13, magnetic poles 61, 62, 63, 64, and 65, a developer controller (doctor blade) 15, and a developer outlet 17.

The development member 10Y develops an electrostatic latent image formed on the photoconductor 1Y into a yellow toner image with yellow toner. When the toner image formed on the photoconductor 1Y opposing the development member 10 is transferred to a recording sheet P via the intermediate transfer belt 121 (or directly transferred to the recording sheet P), the fixing unit 140 fixes the toner image on the recording sheet P. Thereafter, the toner image is discharged as an output image.

The development member 10Y is a two-component development member, using developer mixed with toner and magnetic carrier. The developer conveyance path 31*a* is provided above the casing 11 and connected to the developer transfer member 31 depicted in FIG. 2, and conveys developer by a flow of air such that the developer is conveyed in a direction parallel to the development roller 12. A collection path including the collection screw 13 is provided in a lower portion of the casing 11, and collects developer used for development from the development roller 12.

The development roller 12 includes an outer nonmagnetic cylindrical development sleeve, and functions as a magnetic field generator. The magnetic field generator may, for example, be a magnetic roller provided with the plurality of magnetic poles 61, 62, 63, 64, and 65, or a plurality of magnets. The development roller 12 develops a latent image formed on the photoconductor 1Y into a toner image with toner included in the developer by the magnetic field generator attracting the developer to, and retaining the developer on, the surface of the roller, that is, the development sleeve.

More specifically, the magnetic poles (conveyance poles) 61, 62, and 63 carry and convey developer, the magnetic pole (development pole) 64 is a main pole for developing an electrostatic latent image formed on the photoconductor 1Y with developer carried by the magnetic poles 61, 62, and 63, and the magnetic pole (conveyance pole) 65 carries and conveys the developer used for development to the collection screw 13. When conveyed to an area without magnetic poles (developer releasing portion), the developer falls into the collection path. The magnetic poles 61 and 65 provided across the developer releasing portion preferably have the same magnetic polarity, thereby efficiently releasing the developer from the development roller 12 due to the repulsive magnetic force field generated thereby. If the magnetic poles 61 and 65 do not have the same polarity, the magnetic poles 61 and 65 need to be separated from each other to enable the developer properly to fall into the collection path.

According to this illustrative embodiment, the magnetic poles 61, 62, 63, 64, and 65 alternate in polarity. That is, for example, the magnetic pole 61 has a south pole, the magnetic pole 62 has a north pole, the magnetic pole 63 has a south pole, the magnetic pole 64 has a north pole, and the magnetic pole 65 has a south pole.

The doctor blade 15, serving as a developer controller, is provided in an upper portion of an opening of the casing 11 and regulates thickness of the developer carried by the development roller 12, serving as a developer carrier. The developer outlet 17 is provided upstream from the doctor blade 15 in a direction of conveyance of the developer and downstream from the developer releasing portion on the surface of the development roller 12, such that the developer falls from the developer outlet 17.

The developer transfer members 30 and 31 depicted in FIG. 2, which connect the development member 10Y and the developer agitation member 40Y, are tubes of metal, resin, rubber, or the like, and form a developer transfer path.

Figure 4:
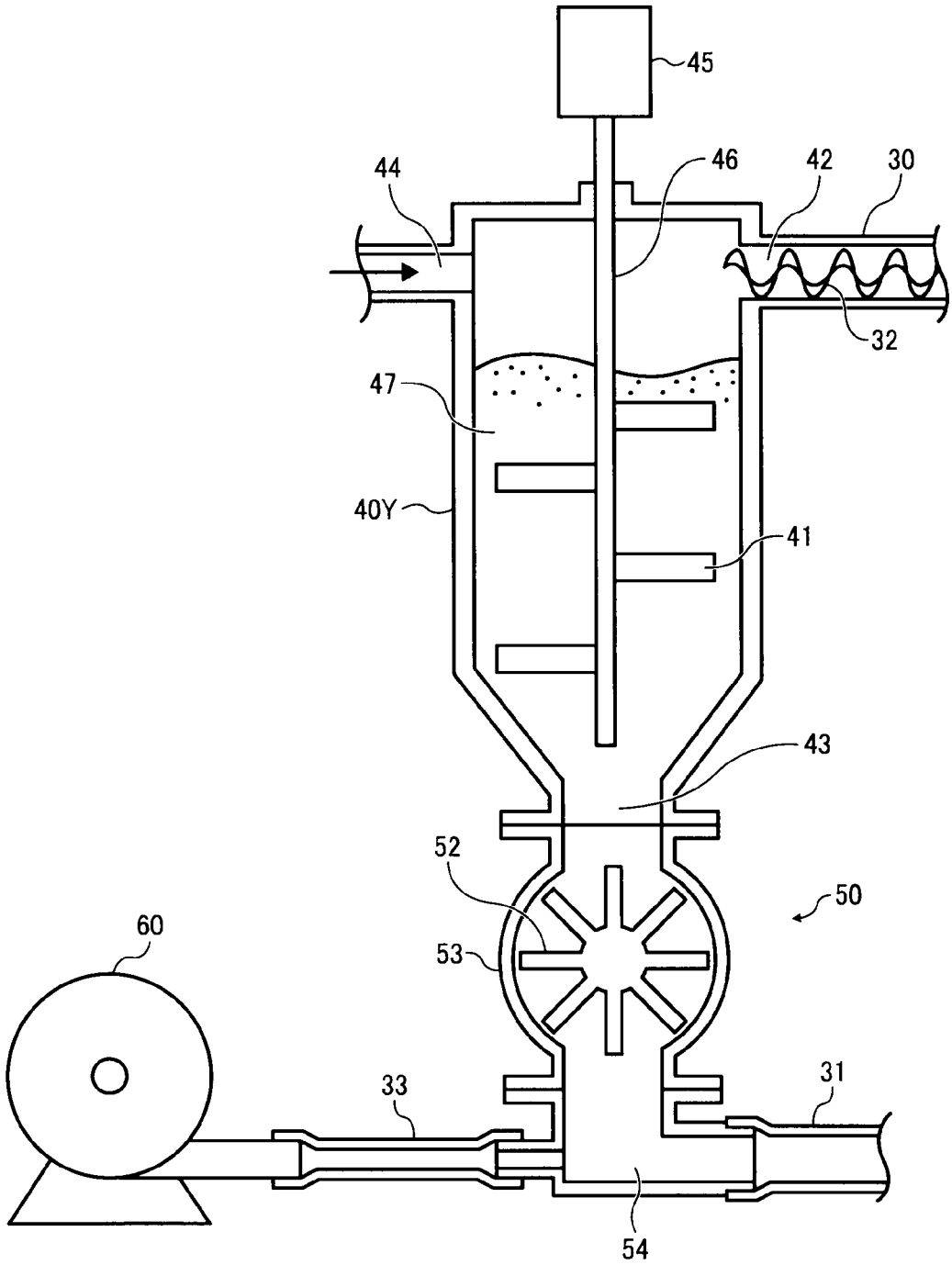
FIG. 4 is a schematic sectional view of a developer agitation member, a rotary feeder, and an air supplier included in development device shown in FIG. 2.

Referring to FIG. 4, a description is now given of a structure of the developer agitation member 40Y. FIG. 4 is a schematic sectional view of the developer agitation member 40Y and the rotary feeder 50. The developer agitation member 40Y includes a developer inlet 42, a developer outlet 43, a toner supply inlet 44, an agitator 46, and a plurality of agitation blades 41. The rotary feeder 50 includes a holder 53, a rotor 52, and a lower portion 54. The developer transfer member 30 includes an auger 32.

The agitator 46 is provided inside the developer agitation member 40Y, and driven to rotate by the motor 45 provided outside the developer agitation member 40Y to agitate developer 47. The plurality of agitation blades 41 is attached to the agitator 46, and agitates the developer 47 as the agitation blades 41 rotate.

The rotary feeder 50 discharges the developer 47. The rotor 52 includes a plurality of blades. The airflow generator 60 is a blower or an air pump, for example, and connected to the rotary feeder 50 via the tube 33 or the like to supply air to the rotary feeder 50. The rotary feeder 50 and the air supplier 60 form a transfer member for supplying the developer 47.

Referring back to FIG. 2, the developer container 20 stores toner inside thereof, and is made of metal, resin, or the like. The toner supply path 21 connects the toner container 20 with the developer agitation member 40Y. A coil screw is provided inside the toner supply path 21, and driven to rotate by the motor 28 to supply toner to the developer agitation member 40Y through the toner supply inlet 44 depicted in FIG. 4. Alternatively, a flow of air may be used to supply toner from the toner container 20 to the developer agitation member 40Y. For example, a powder pump may be connected to a toner outlet of the toner container 20, so that toner can be transferred to the toner supply path 21 by the flow of air with a flexible pipe, thereby allowing the toner container 20 to be disposed in any given position.

Referring to FIGS. 2, 3, 4, 5, 6, and 7, a description is given of circulation of the developer. When the rotor 52 depicted in FIG. 4 of the rotary feeder 50 is driven to rotate by the motor 51, developer sequentially falls from the developer agitation member 40 to the inside of the rotor 52 due to its own weight and is discharged to the lower portion 54 of the rotary feeder 50Y. The discharged developer together with the flow of air is conveyed to the development member 10Y via the developer transfer member 31 depicted in FIG. 2 by air pressure generated by the air supplier, and transferred to the developer conveyance path 31*a* depicted in FIG. 3 of the development member 10Y connected to the developer transfer member 31.

As illustrated in FIG. 3 and described above, the developer conveyance path 31*a* is provided in the developer member 10Y such that developer is conveyed in a direction parallel to the development carrier 12. The developer outlet 17 is provided below the developer conveyance path 31*a*, and discharges developer present in the developer conveyance path 31*a* to the outside of the developer conveyance path 31*a*. The slit-like developer outlet 17 opens along the direction of conveyance of the developer, so that the developer discharged from the outlet (opening) 17 directly falls to the surface of the development carrier.

Since the slit-like developer outlet (opening) 17 is provided below the developer conveyance path 31*a*, the developer falls under its own weight and is supplied to the development roller 12. If the developer outlet (opening) 17 is too large (a width of the slit is too large), a great amount of developer may fall to a front side of the development roller 12, so that the developer cannot be supplied to a back side of the development roller 12. Therefore, adjustment of the width of the opening of the developer outlet 17 in advance equalizes the amount of developer supplied to the development roller 12 in the axial direction of the development roller 12.

Figure 5:
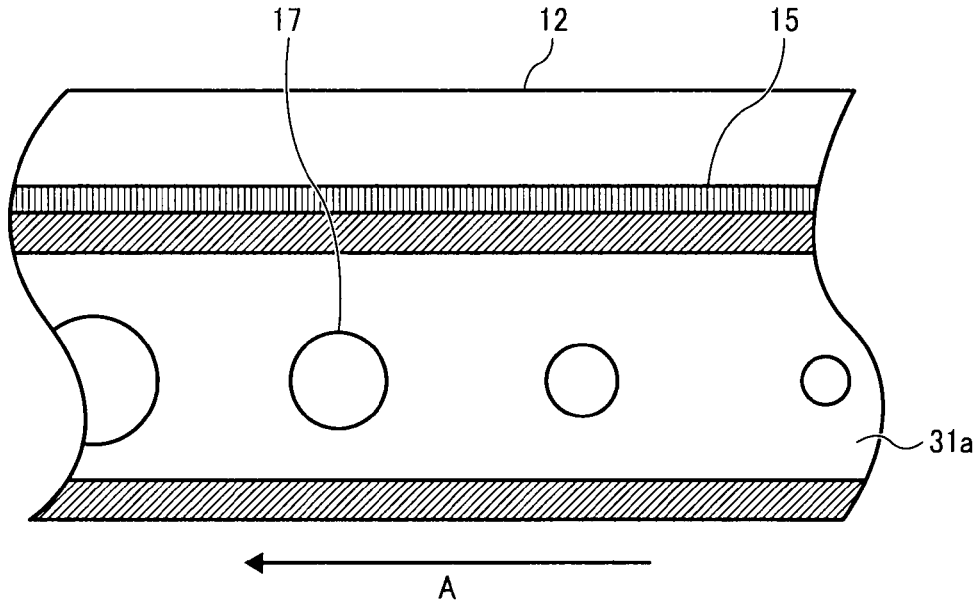
FIG. 5 is an enlarged partial view of a developer conveyance path included in the development device shown in FIG. 2 illustrating an example of an opening of the developer conveyance path.
Figure 6:
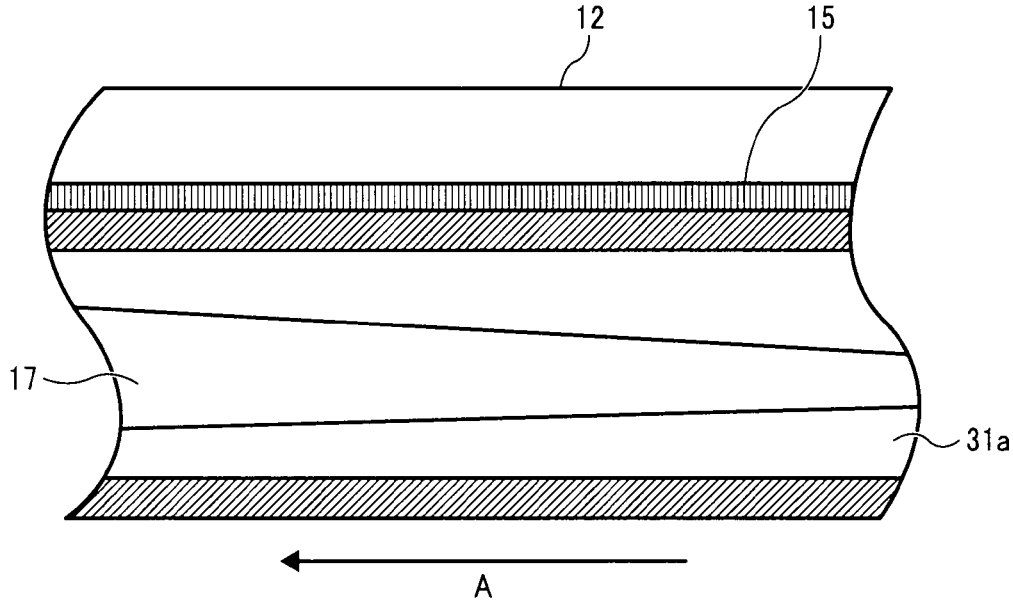
FIG. 6 is an enlarged partial view of a developer conveyance path included in the development device shown in FIG. 2 illustrating another example of an opening of the developer conveyance path.

FIGS. 5 and 6 are sectional views of the developer conveyance path 31*a* seen from the top of FIG. 3 and illustrate examples of a shape of the developer outlet 17 of the development member 10Y. As illustrated in FIG. 6, since the width of the opening of the developer outlet 17 is larger toward the back of the developer conveyance path 31*a* in a direction of movement A of developer indicated by an arrow in the drawing, the amount of developer falling under its own weight is smaller than the amount of developer flowing through the developer conveyance path 31*a*, so that the developer can be supplied to the back of the development roller 12. It is to be noted that, alternatively, instead of provision of the slit-like outlet 17, the developer outlet 17 may include a plurality of holes, as illustrated in FIG. 5.

Figure 7:
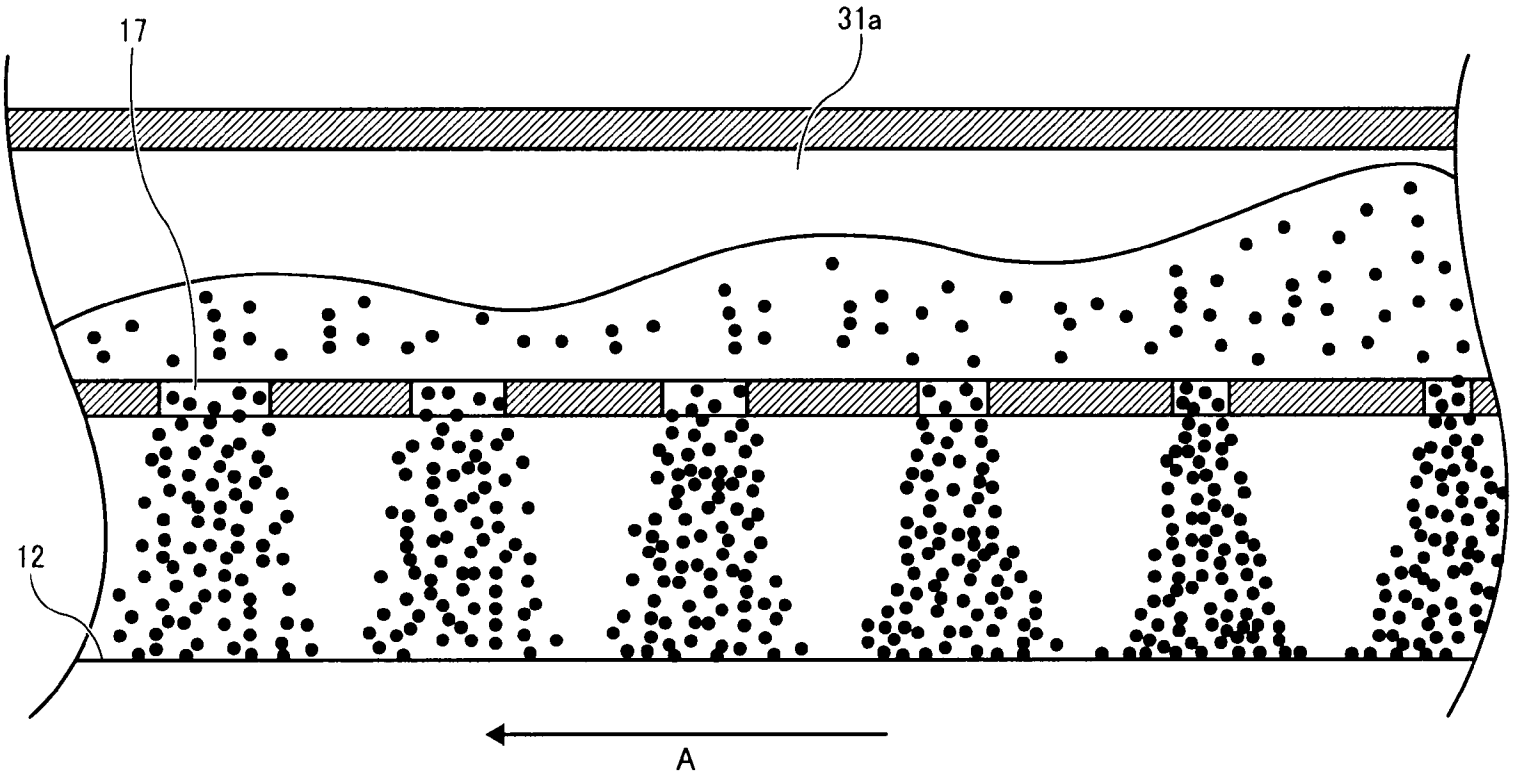
FIG. 7 is a partial sectional view of the developer conveyance path illustrating a state of developer flowing though the openings shown in FIG. 5.

FIG. 7 is a schematic sectional view of the developer conveyance path 31*a* seen from the left of FIG. 3 illustrating a state of developer flowing though the holes provided in the developer outlet 17 depicted in FIG. 5. Even if each of the plurality of holes is separated from other, when the opening of the developer outlet 17 is kept away from the development roller 12, the developer flowing from the holes spreads out as illustrated in FIG. 7, thereby uniformly supplying the developer to the development roller 12.

That is, as illustrated in FIG. 5 or 6, since the area of the opening hole or the width of the slit is larger toward the back of the developer conveyance path 31*a* in the direction of movement A of the developer, the amount of developer supplied to the development roller 12 can be equalized.

As illustrated in FIG. 7, as the amount of the developer flowing in the developer conveyance path 31*a* decreases in the direction of movement A of the developer, the rate at which the developer falls from the developer outlet 17 decreases. In other words, the rate of discharging developer varies according to the weight of the developer existing above the developer outlet 17. Therefore, as illustrated in FIG. 5 or 6, the size of the opening hole or the width of the slit is larger toward the back of the developer conveyance path 31*a* in the direction of movement A of the developer, thereby increasing the amount of developer falling to the development roller 12 under its own weight, so that the developer can be equally supplied to the development roller 12 in a longitudinal direction of the development roller 12.

Thereafter, the developer falling to the development roller 12 is attracted to the conveyance magnetic pole 61 depicted in FIG. 3 provided inside the development roller 12, and is conveyed while being successively held by the conveyance pole (doctor pole) 62, the conveyance pole 63, and the development pole 64. Then, when reaching the collection path via the conveyance pole 65, the developer separates from the development roller 12 to enter the collection path. After the collection screw 13 conveys the developer to the developer transfer member 30 depicted in FIG. 2, the developer returns to the developer agitation member 40. As the developer agitation member 40 continues to store decreasing amounts of toner due to consumption of the toner during development of the toner images, the toner container 20 supplies more toner to the developer agitation member 40Y, in which the agitator 46 depicted in FIG. 4 mixes, agitates, and disperses the toner and the developer, so that the toner density and the amount of charged toner is appropriately adjusted.

According to this illustrative embodiment, the development member 10 of the development device 4Y includes the developer conveyance path 31*a* and the developer outlet 17. The developer conveyance path 31*a* is provided such that the developer is conveyed in a direction parallel to the development roller 12, and conveys the developer due to the flow of air. The developer outlet 17, through which the developer flowing in the developer conveyance path 31*a* is discharged to the outside of the developer conveyance path 31*a*, is provided in the developer conveyance path 31*a* and above the development carrier 12, so as to be open along the direction of conveyance of the developer, and thus, the developer discharged from the outlet 17 directly falls to the development roller 12, thereby uniformly supplying the developer to the development roller 12 in the longitudinal direction (axial direction) of the development roller 12. Therefore, the amount of the developer supplied to the development roller 12 in the axial direction thereof can be equalized, so as to form a magnetic brush made of the developer uniformly supplied to the development roller 12, thereby forming a high-quality image without unevenness of toner density. In addition, since the developer is conveyed by the flow of air, a size of the conveyance path 31*a* can be decreased, thereby making the development member 10 more compact.

Figure 8:
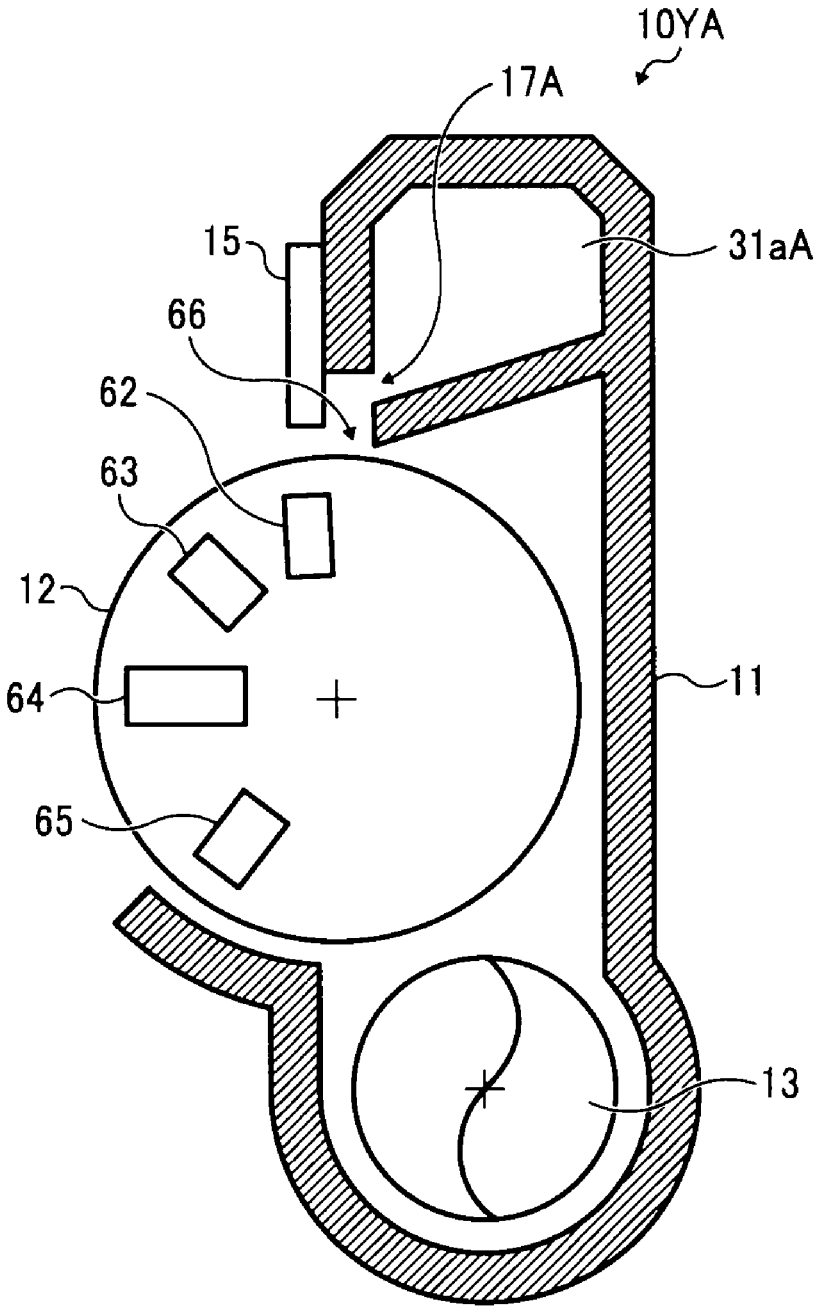
FIG. 8 is a schematic sectional view of a modification of the development member shown in FIG. 3.

Referring to FIG. 8, a description is now given of a development member 10YA as a modification of the development member 10. FIG. 8 is a schematic sectional view of the development member 10YA. The development member 10YA includes a developer conveyance path 31*a*A, a developer outlet 17A, and a developer thickness controller portion 66 formed by the doctor blade 15.

The development member 10YA differs from the development member 10 of FIG. 3 in that the developer outlet (opening) 17A of the developer conveyance path 31*a*A is provided in the vicinity of the doctor blade 15, and development member 10YA does not include the conveyance magnetic pole 61. Therefore, the developer falling through the developer outlet 17A is directly conveyed to the developer thickness controller portion 66.

The vicinity of the doctor blade 15 is a portion in which, even when the development roller 12 has no magnetic polarity for conveying the developer to the doctor blade 15, a surface frictional force and a rotational force of the development roller 12 can prevent the developer from slipping from the development roller 12, or a portion in which, even when the developer partially slips from the development roller 12, a sufficient amount of developer can be conveyed to the doctor blade 15. More specifically, the position can be defined experimentally under conditions in which fluidity of the developer, the frictional force, the rotational force, and the like, are set.

More preferably, as illustrated in FIG. 8, when the developer falls to the substantially top portion of the development roller 12 (the highest portion of the development roller 12 in a horizontal direction of the development roller 12), the developer falling to the development roller 12 can be carried by the frictional force of the surface of the development roller 12, so that the development member 10YA does not need to include the conveyance magnetic pole 61 depicted in FIG. 3.

Accordingly, the development member 10YA does not need to include the conveyance magnetic pole 61 before controlling the thickness of the developer, thereby reducing its cost while preventing the developer from accumulating in the developer thickness controller portion 66, as well as reducing stress on the developer.

That is, if the developer held by the magnetic force of the conveyance magnetic pole 61 accumulates in the developer thickness controller portion 66, the friction of the developer increases, accelerating deterioration of the developer. However, in the development member 10YA, the developer falling to the development roller 12 directly enters the developer thickness controller portion 66 and does not accumulate in front of the developer thickness controller portion 66, thereby reducing the stress on the developer. Thus, provision of the developer outlet 17A in the vicinity of the doctor blade 15 can prevent the developer from excessive shearing, so that the amount of the developer can be properly maintained, thereby reducing damage to the developer.

Figure 9:
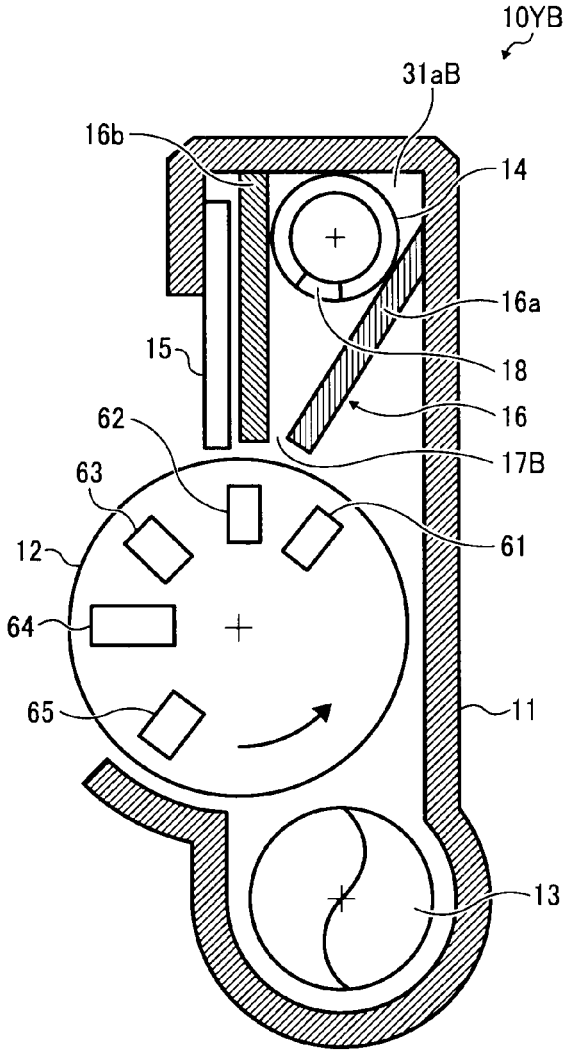
FIG. 9 is a schematic sectional view of a development member according to another illustrative embodiment.

Referring to FIG. 9, a description is now given of a development member 10YB according to another illustrative embodiment. FIG. 9 is a schematic sectional view of the development member 10YB. The development member 10YB includes a developer conveyance path 31*a*B, a developer conveyer 14, an exit 18, a developer holder 16 including walls 16*a* and 16*b* and a developer outlet 17B.

The developer conveyer 14 is provided inside the developer conveyance path 31*a*B, and conveys the developer inside the developer conveyer 14 in the longitudinal direction of the development roller 12. The exit 18 of the developer conveyer 14 discharges the developer from the developer conveyer 14. The developer holder 16 receives and holds the developer discharged from the exit 18. The developer outlet 17B, serving as a second developer outlet, is provided in the developer holder 16.

In a conventional development device using a screw that attracts developer magnetically to supply the developer to a development roller, since the developer may flow unevenly depending on the screw pitch, the amount of developer attracted to the development roller may vary, causing generation of uneven toner density image. However, according to the above-described illustrative embodiment, the development member 10Y depicted in FIG. 3 or the development member 10YA depicted in FIG. 8 can prevent generation of such uneven toner density image. Moreover, since the development member 10Y or the development member 10YA does not need to include the screw for supplying developer to the development roller and has a simple structure, it is more useful and less expensive than the conventional development device.

However, even the development member 10Y or the development member 10YA may convey the developer in clusters, so that the developer is unevenly supplied to the development roller 12. Therefore, using a flow of air to supply the developer to the development roller 12, the development member 10YB more effectively prevents uneven supply of the developer than the development member 10Y or the development member 10YA.

To be more specific, in the development member 10Y depicted in FIG. 3 in which the doctor blade 15 scrapes the developer conveyed to the development roller 12 to smooth the thickness of the developer, when the developer is unevenly supplied to the development roller 12 before the development roller 12 passes the doctor blade 15, since resistance of the doctor blade 15 to the developer varies, the amount of the developer conveyed to the development roller 12 or the amount of charged toner may vary, causing a faulty output image with uneven toner density.

In the development device 4Y for conveying the developer using the flow of air, according to an air supply condition, the developer is not evenly conveyed by the flow of the air though the tubular-shaped developer transfer member 31 depicted in FIG. 2, but tends to be conveyed in clusters through the developer transfer member 31. This is called "plug transfer" and is generated in conveyance of powder by flow of air at low speed.

Therefore, when the developer outlet (opening) 17 is provided in the developer conveyance path 31*a*B connected to the developer transfer member 31 to directly supply the developer to the development roller 12, the amount of developer falling to the development roller 12 may vary.

According to this illustrative embodiment, the development member 10YB depicted in FIG. 9 can prevent such variation in the amount of developer falling to the development roller 12.

More specifically, even if the amount of the developer discharged from the exit 18 in the longitudinal direction of the development roller 12 varies, the developer holder 16 holds the developer, thereby reducing the variation in the amount of developer discharged from the exit 18.

Therefore, a constant amount of the developer can be discharged from the developer outlet 17B, so that the developer can be uniformly supplied to the development roller 12 in the longitudinal direction of the development roller 12.

Moreover, since the walls 16*a* and 16*b* of the developer holder 16 can effectively hold the developer to be supplied to the development roller 12 through the outlet 17B provided in the lower portion of the developer conveyance path 31*a*B, the outlet 17B has uniform width, so that the developer can move to the development roller 12 without accumulation.

Referring to FIGS. 9, 10, 11, 12, 13, and 14, a structure of the development member 10YB of the development device 4Y is described. It is to be noted that the whole structure of the development device 4Y is equivalent to that of the development device 4Y depicted in FIG. 2. Moreover, each of the development roller 12, serving as a developer carrier, and the collection screw 13, serving as a collection path, has a structure similar to that of each of the development roller 12 and the collection screw 13 of the development member 10Y depicted in FIG. 3.

As described above, the developer conveyer (developer transfer tube) 14 is provided inside the developer conveyance path 31*a* and connected to the developer transfer member 31 depicted in FIG. 2. The exit 18 (opening A) is provided in the lower portion of the developer conveyer (developer transfer tube) 14, and discharges the developer from the developer conveyer 14. The developer holder 16 is provided below the developer conveyer 14, and receives and holds the developer discharged from the exit 18 of the developer conveyer 14. The developer outlet 17B is provided in the developer holder 16.

The opposing walls 16*a* and 16*b* of the developer holder 16 are provided below the developer conveyer 14. The slit-shaped developer outlet 17B (opening B) is provided below the walls 16*a* and 16*b*. Provision of the walls 16*a* and 16*b* and the developer outlet 17B (opening B) helps the developer to move to the development roller 12 without accumulation.

Figure 10:
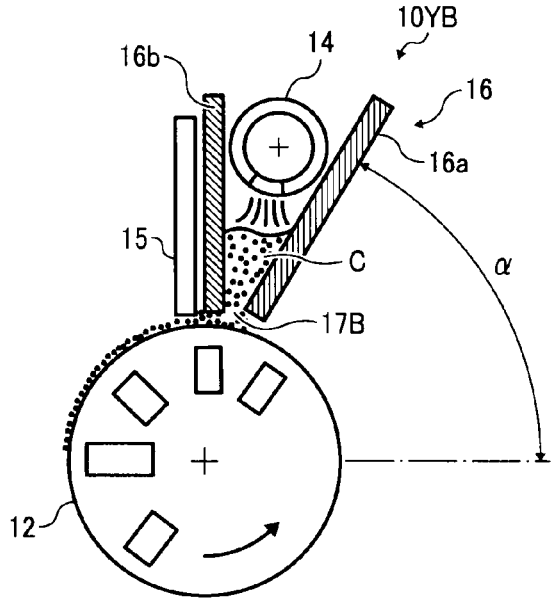
FIG. 10 is a partial view of the development member shown in FIG. 9.

FIG. 10 is a schematic sectional view of the development member 10YB illustrating a proper inclination angle $\alpha$ of the opposing walls 16*a* and 16*b* of the developer holder 16 with respect to a horizontal plane. The inclination angle $\alpha$ is greater than a repose angle, at which the developer easily falls to the developer carrier 12, defined by an injection method. As one example of a result of measurement using the injection method, the inclination angle $\alpha$=60 degrees. Thus, when the angle $\alpha$ of the wall 16*a* is greater than or equal to 60 degrees, the developer can flow smoothly down the inclined wall 16*a*, so that the developer can be uniformly supplied to a surface of the development roller 12 without accumulation.

As with the development members 10Y and 10YA, the developer used for development is collected by the collection path provided in the lower portion of the casing 11 and transferred to the developer agitation member 40Y depicted in FIG. 2 through the developer transfer member 30. When the toner container 20 supplies fresh toner that is mixed with the developer returned to the developer agitation member 40Y, agitated, and dispersed, toner is supplied with an electrical charge.

Referring again to FIG. 4, it can be seen that the developer agitation member 40Y includes the developer inlet 42, the developer outlet 43, and the toner supply inlet 44.

The agitator 46 is provided inside the developer agitation member 40, and driven to rotate by the motor 45 provided outside the developer agitation member 40Y. The plurality of agitation blades 41 is attached to the agitator 46, and agitates developer as rotation of the agitation blades 41.

The rotary feeder 50 discharges the developer from the developer agitation member 40, and includes the holder 53 and the rotor 52 including a plurality of blades. The airflow generator 60 is, for example, a blower or an air pump, and connected to the rotary feeder 50 via the tube 33 or the like to supply air to the rotary feeder 50. The rotary feeder 50 and the airflow generator 60 form a transfer member for supplying developer.

The developer container 20 stores toner inside thereof, and is made of metal, resin, or the like. The toner supply path 21 connects the toner container 20 with the developer agitation member 40Y. A coil screw is provided inside the toner supply path 21, and driven to rotate by the motor 28 to supply toner to the developer agitation member 40Y through the toner supply inlet 44 depicted in FIG. 4. Alternatively, flow of air may be used for supply of toner from the toner container 20 to the developer agitation member 40Y. For example, a powder pump may be connected to a toner outlet of the toner container 20, so that toner can be transferred to the toner supply path 21 by the flow of air using a flexible pipe, thereby allowing the toner container 20 to be disposed in any given position.

When the rotor 52 depicted in FIG. 4 of the rotary feeder 50 is driven to rotate by the motor 51, developer sequentially falls from the developer agitation member 40 to the inside of the rotor 52 due to its own weight and is discharged to the lower portion 54 of the rotary feeder 50Y. The discharged developer together with the flow of air is conveyed to the development member 10Y via the developer transfer member 31 depicted in FIG. 2 by air pressure generated by the air supplier, and transferred to the developer conveyance path 31*a* depicted in FIG. 3 of the development member 10Y connected to the developer transfer member 31.

As illustrated in FIG. 9, the development roller 12, serving as a developer carrier, of the development member 10YB includes a nonmagnetic cylindrical development sleeve and a magnetic field generator provided inside the sleeve, for example, a magnetic roller attached with the plurality of magnetic poles 61, 62, 63, 64, and 65, or a plurality of magnets, and develops a latent image formed on the photoconductor 1Y into a toner image with toner included in the developer while holding the developer on a surface of the roller (the development sleeve).

The doctor blade 15, serving as a developer controller, is provided in an upper portion of an opening of the casing 11, and controls thickness of developer carried by the development roller 12. The developer outlet 17B of the developer holder 16 is provided such that the developer falls to the surface of the development roller 12 in the upstream side from the doctor blade 15 in the direction of conveyance of the developer.

The doctor blade 15 controls the amount of the developer absorbed by the development roller 12 to keep a predetermined mount of developer, and electrically charges toner by shearing the developer.

The developer conveyer 14 is a tubular member provided with the exit 18, serving as an opening A, in the lower portion of the developer conveyer 14, and supplies developer to the development roller 12, so that the developer supplied from the developer transfer member 31 depicted in FIG. 2 by the flow of air into the developer conveyer 14 drops from the exit 18. The exit 18 of the developer conveyer 14 includes a series of circular holes. Alternatively, the exit 18 may be a slit-like opening.

A characteristic feature of this illustrative embodiment is that the developer holder 16 is provided below the developer conveyer 14. The developer outlet 17B is provided in the lower portion of the developer holder 16, and preferably a slit-like opening having a predetermined width. According to this illustrative embodiment, the development member 10YB includes two openings, that is, the exit 18 (opening A) and the outlet 17B (opening B), through which the developer flows down, thereby stably supplying the developer to the development roller 12.

Since the developer is conveyed in clusters by the flow of air, the amount of developer falling from the exit 18 (opening A) varies. However, according to this illustrative embodiment, due to provision of the developer holder 16, the developer is once stored in a space formed between the walls 16*a* and 16*b* of the developer holder 16, and a predetermined amount of the developer can be stably supplied from the developer outlet 17B (opening B) to the development roller 12.

Since the developer outlet 17B separates from the development roller 12 at a proper distance in consideration of fluidity of the developer, surface friction of the development roller 12, a position on the development roller 12, or the like, such that a predetermined amount of developer is kept in the vicinity of the development roller 12, that is, in the developer holder 16, even when a small amount of developer is discharged from the exit 18 of the developer conveyer 14. Thus, due to the magnetic force of the magnetic poles 61, 62, 63, 64, and 65, provided inside the development roller 12, a predetermined amount of developer can be attracted to the surface of the development roller 12 and conveyed. Moreover, when the developer holder 16 holds a decreased amount of developer since the developer adheres to the development roller 12, the developer conveyer 14 sequentially supplies developer from the exit 18, so that a constant amount of developer can be supplied to the development roller 12.

In addition, the area of the opening or the width of the slit of the exit 18 of the developer conveyer 14 in the upstream of the exit 18 in the direction of conveyance of the developer may be greater than the area of the opening or the width of the slit of the exit 18 of the developer conveyer 14 in the downstream of the exit 18, thereby preventing variation in the amount of developer falling to the developer holder 16 in the longitudinal direction of the development roller 12, so that the developer can be stably and effectively supplied to the development roller 12.

Figure 11:
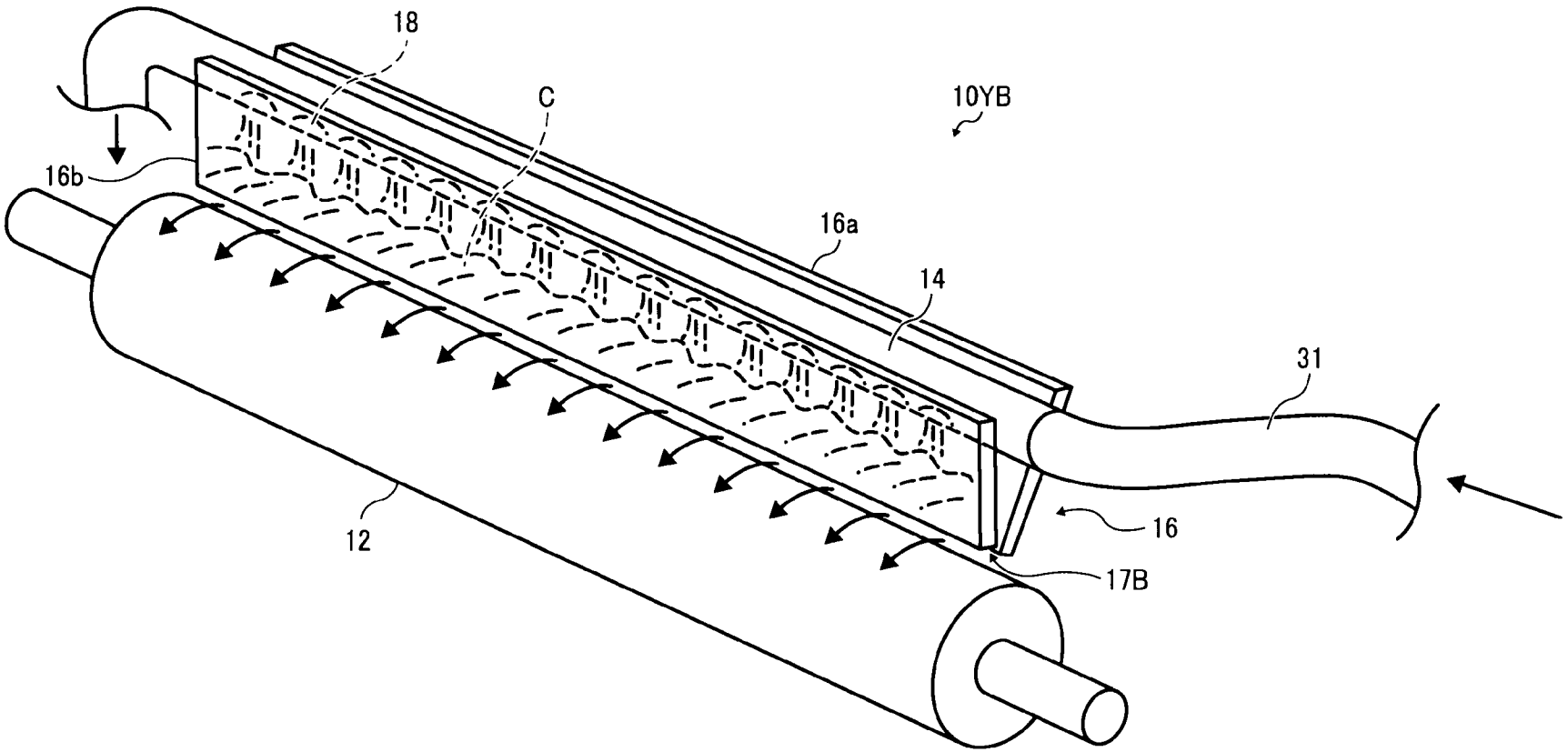
FIG. 11 is a perspective view of the development member shown in FIG. 9.

FIG. 11 is a schematic perspective view of the development roller 12, the developer conveyer 14, and the developer holder 16 of the development member 10YB depicted in FIG. 10.

When fed from the developer agitation member 40Y depicted in FIG. 2 through the developer transfer member 31, the developer drops from the exit 18 (opening A) provided in the upper portion of the developer conveyer 31*a*B and held by the developer holder 16 to form a developer puddle C. Then, a predetermined amount of the developer caught in the developer puddle C is supplied from the slit-like outlet 17B (opening B) of the developer holder 16 to the surface of the development roller 12. That is, sizes (widths, or the like) of the exit 18 of the developer conveyer 14 and the outlet 17B of the developer holder 16 are set such that the amount of developer discharged from the exit 18 (opening A) of the developer conveyer 14 is smaller than the amount of developer discharged from the outlet 17B of the developer holder 16. Therefore, even when the amount of developer existing in the developer conveyer 14 varies, the developer conveyer 14 sequentially supplies developer from the exit 18 (opening A) to a portion of the developer puddle C consuming the developer, thereby stably supplying a predetermined amount of the developer.

Figure 12:
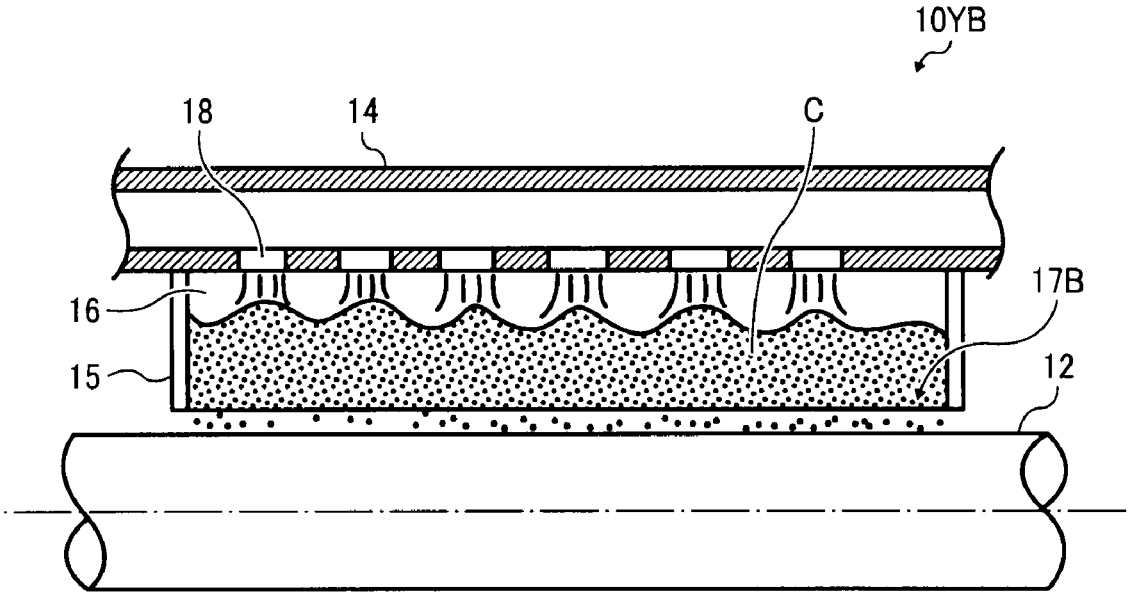
FIG. 12 is a schematic sectional view of the development member shown in FIG. 11.
Figure 13:
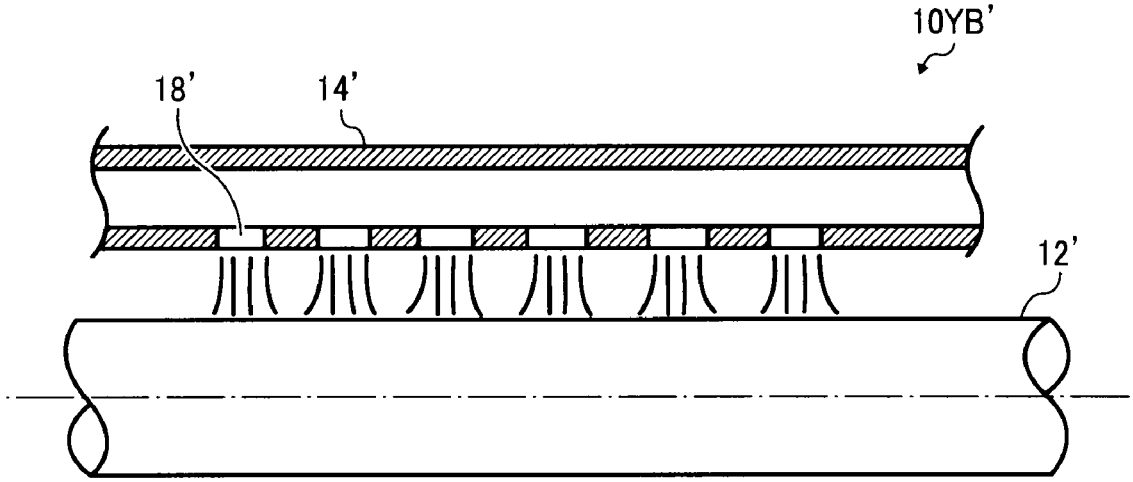
FIG. 13 is a schematic sectional view of a related-art development member.

FIG. 12 is a schematic sectional view of the development member 10YB illustrating a state of developer supplied to the development roller 12, and FIG. 13 is a schematic sectional view of a development member 10YB' illustrating a state of developer supplied to a development roller 12'. The development member 10YB' does not include the development holder 16. In the development member 10YB' of FIG. 13, the amount of developer supplied to the development roller 12' varies with changes in the amount of developer falling down through an exit 18' (opening A) of a developer conveyer 14'. However, in the development member 10YB of FIG. 12, due to provision of the development holder 16, the developer can be uniformly supplied to the development roller 12.

As illustrated in FIG. 10, in order to stably supply the developer to the development roller 12, the developer accumulated in the developer puddle C needs to be supplied to the development roller 12 without staying in the developer puddle C. Thus, the inclination angle $\alpha$ is preferably greater than a repose angle at which the developer easily drops the wall 16*a* of the developer holder 16. As described above, the repose angle is determined by an injection method. As one example of a result of measurement using the injection method, the inclination angle $\alpha$ is greater than or equal to 60 degrees.

Figure 14:
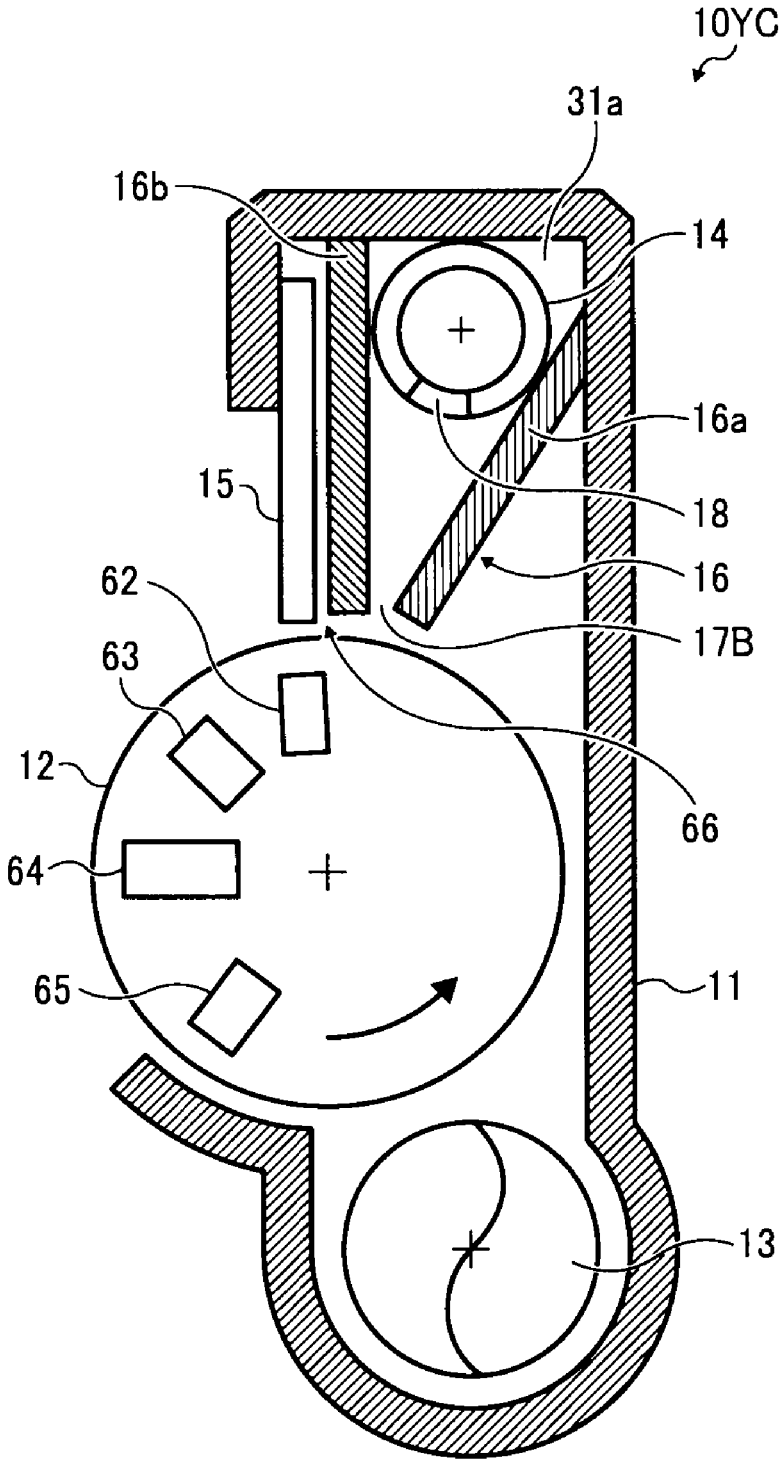
FIG. 14 is a schematic sectional view of a modification of the development member shown in FIG. 9.

Referring to FIG. 14, a description is now given of a development member 10YC. FIG. 14 is a schematic sectional view of the development member 10YC. The development member 10YC does not include the conveyance magnetic pole 61 depicted in FIG. 9. Since the magnetic poles 62, 63, 64, and 65 are disposed similarly to those of FIG. 8, and the developer outlet 17B of the developer holder 16 is provided in the vicinity of the doctor blade 15, the magnetic pole 61 does not need to be provided in the development member 10YC, thereby reducing cost, as well as preventing the developer from accumulating in the developer thickness controller portion 66, and reducing stress on the developer.

The vicinity of the doctor blade 15 is a portion in which, even when the development roller 12 has no magnetic polarity for conveying the developer to the doctor blade 15, surface friction force and rotational force of the development roller 12 can prevent the developer from slipping from the development roller 12, or a portion in which, even when the developer partially slips from the development roller 12, a sufficient amount of developer can be conveyed to the doctor blade 15. More specifically, the position can be defined by an experiment performed under conditions in which fluidity of the developer, the frictional force, the rotational force, and the like, are set.

More preferably, as illustrated in FIG. 14, when the developer falls to the substantially top portion of the development roller 12 (the highest portion of the development roller 12 in a horizontal direction of the development roller 12), the developer falling to the development roller 12 can be carried by the frictional force of the surface of the development roller 12, so that the development member 10YA does not need to include the conveyance magnetic pole 61 depicted in FIG. 9.

The advantageous effect of the development device 4Y depicted in FIG. 2 is described.

A conventional development device includes a development member including a developer carrier provided in a casing and holding developer, for example, a development roller including a plurality of magnetic poles provided inside thereof) and two screws circulating the developer, a developer controller, for example, a doctor blade, and the like. One of the screws supplies the developer to the development roller, and the other collects the developer after development. However, when the developer is conveyed using the screw, a surface of the developer is not even, that is, the surface of the developer varies, so that a thin layer of the developer supplied to the development roller has irregularities, causing a uneven faulty image. In order to prevent such irregularities, the surface of the developer needs to be smoothed by reducing a pitch of the screw, or providing a fin in a shaft of the screw. However, since the amount of developer conveyed by the screw decreases, the torque of the screw needs to be increased. In order to increase the torque of the screw, endurance of a bearing of the screw needs to be improved, or rigidity of the screw needs to be increased, thereby increasing cost. Alternatively, the amount of developer conveyed by the screw may be increased to supply an excessive amount of developer to the development roller, so as to prevent the irregularities of pitch of the screw. However, the torque of the screw needs to be increased, or a section size of the screw needs to be increased, thereby increasing the size of the development device. In addition, supply of the excessive amount of the developer may put an unnecessary stress on the development roller and a developer thickness controller of a doctor blade.

Figure 15:
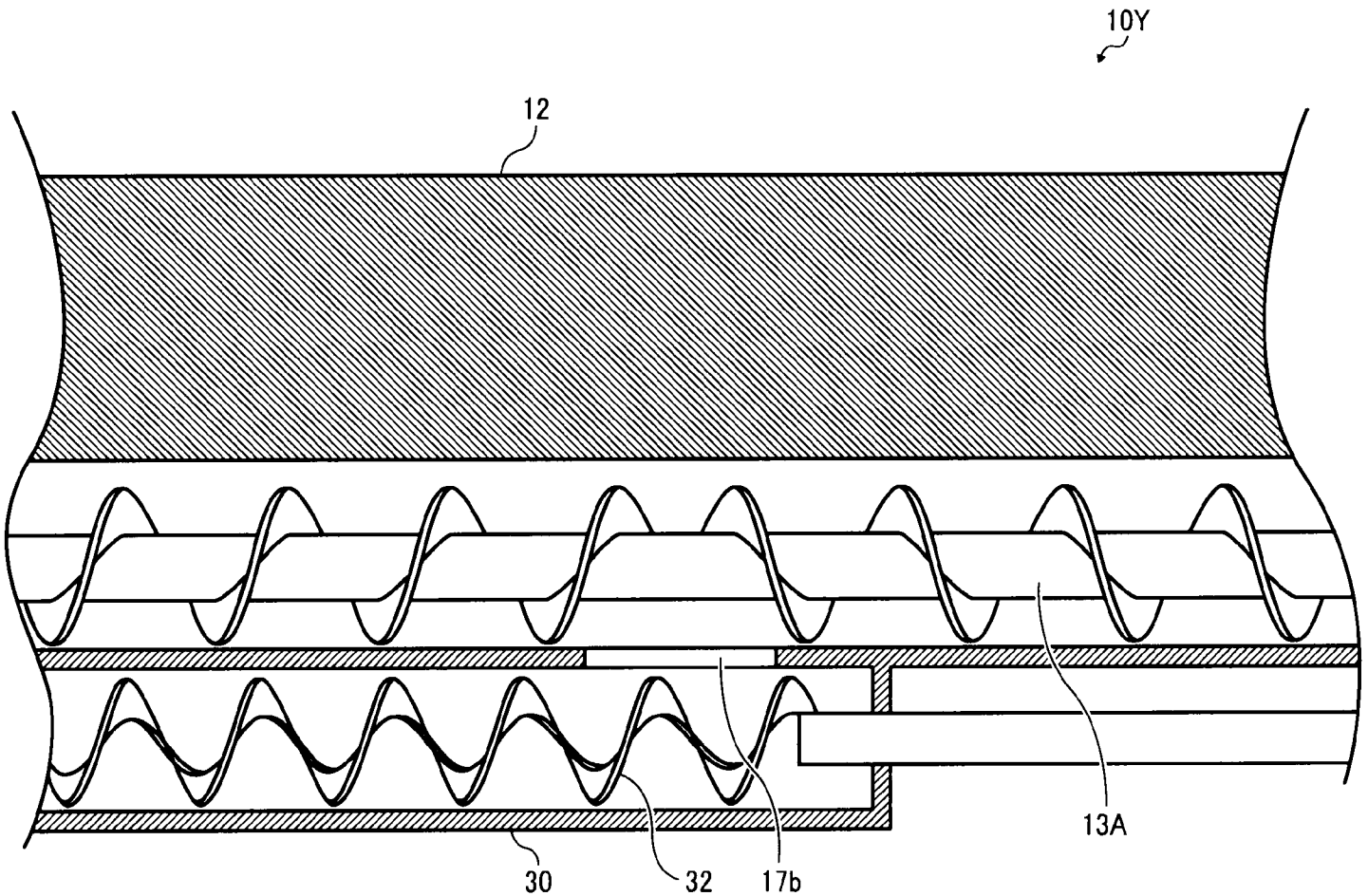
FIG. 15 is an enlarged plan view of an example of a collection screw included in the development member shown in FIG. 3.

However, according to the above-described illustrative embodiments, in the development device 4Y including the development member 10Y depicted in FIG. 3, the development member 10YA depicted in FIG. 8, the development member 10YB depicted in FIG. 10, or the development member 10YC depicted in FIG. 15, for conveying developer inside the developer conveyance path 31 (or the developer conveyer 14 depicted in FIG. 10) by the flow of air, the developer moves using substantially the whole section of the developer conveyance path 31*a* (or the developer conveyer 14), and by increasing the rate of the flowing air, the amount of developer to be transferred per unit time can be easily increased. That is, since conveyance of the same amount of developer by air can reduce the cross-sectional area, the development device 4Y can be made much more compact.

In addition, since the developer conveyance path 31*a* depicted in FIG. 3 or the developer conveyance path 31*a*B depicted in FIG. 10 does not include a screw inside thereof, a surface of the developer does not have irregularities, so that the size of the screw dose not need to be increased in order to supply conveyance force to the screw.

In the conventional development device, in order to circulate the developer inside the development member to transfer the developer from the collection screw to the supply screw, the supply screw and the collection screw need to be close to each other. The same can be said for a conventional development member including screws provided parallel to each other.

However, according to this illustrative embodiment, as illustrated in FIG. 2, since the development member 10Y and the developer agitation member 40Y separates from each other, and the developer transfer members 30 and 31 circulate the developer, as illustrated in FIGS. 3, 8, 9, and 14, the developer conveyance path 31*a* can be separated from the collection screw 13, thereby making the development member 10Y more compact, as well as increasing the degree of freedom of layout of the image forming apparatus 100A depicted in FIG. 1, and in particular, the image forming apparatus 100A which is a tandem-type color copier can be made more compact since it includes four development devices 4Y, 4M, 4C, and 4K.

The development device 4Y includes the collection screw 13 similar to the conventional collection screw. Since an increase in pitch of the screw increases the amount of movement of the screw per rotation, in order to make the development device 4Y more compact, a diameter of the screw is decreased to increase the pitch. However, since the two screws are close to each other and driven by the same driving source to rotate with a gear, pulley, or the like, the torques of the screws cannot be significantly changed.

However, according to the above-described illustrative embodiments, since the development member 10Y, the development member 10YA, the development member 10YB, and the development member 10YC include a single screw (the collection screw 13) for collecting the developer, the torque of the screw can be increased, thereby decreasing the diameter of the collection screw 13.

FIG. 15 illustrates a collection screw 13A as a modification of the collection screw 13. The development member 10Y includes a developer outlet 17*b* provided in a central portion of the development member 10Y in a longitudinal direction thereof, and the collection screw 13A includes blades spiraling in opposite directions at the central portion of the collection screw 13A, so that developer is discharged from the developer outlet 17*b* to the developer transfer member 30. Therefore, the torque of the collection screw 13A is reduced to half the torque of the collection screw 13, thereby making the development member 10Y much more compact.

Figure 16:
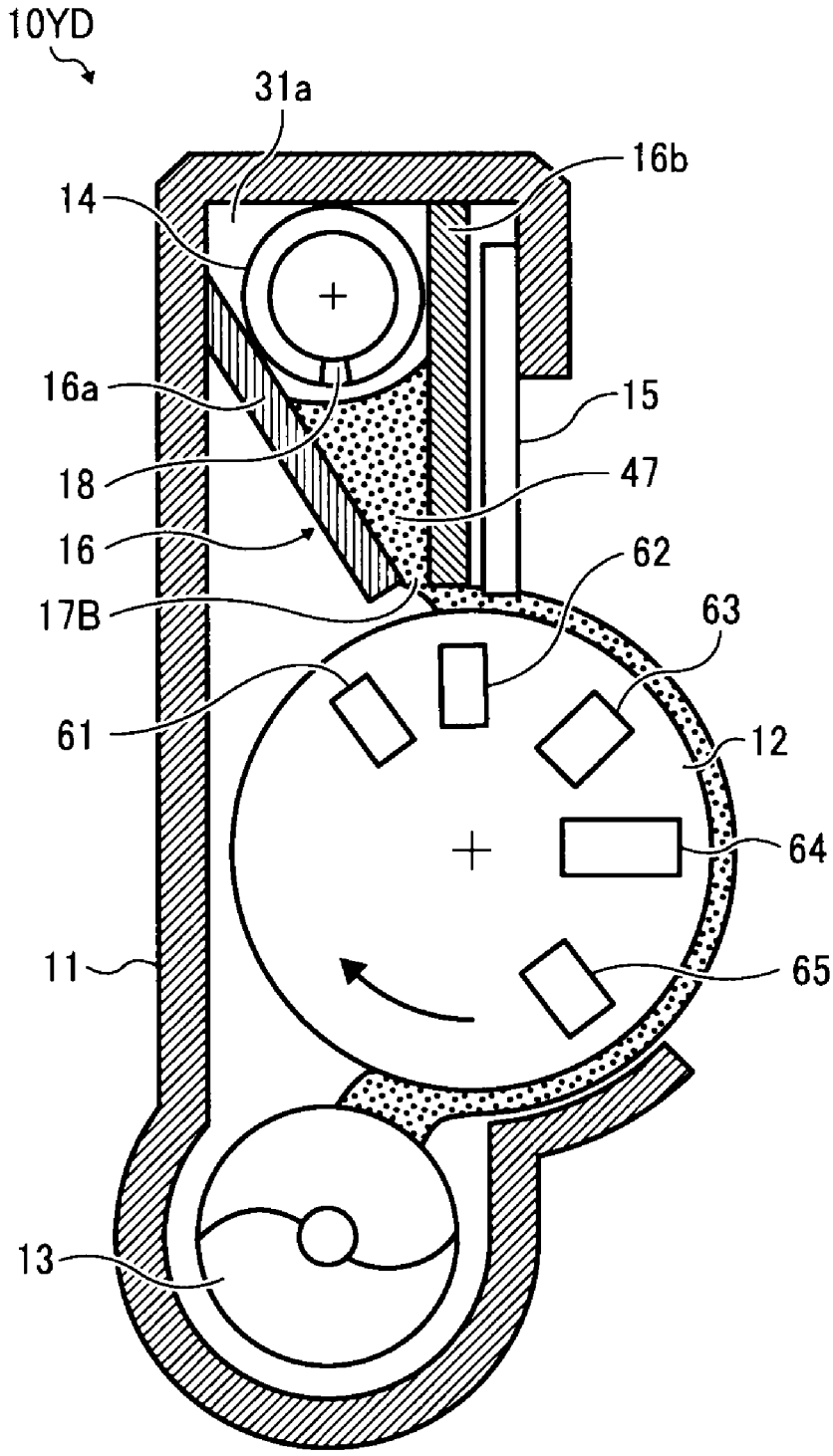
FIG. 16 is a schematic sectional view of a development member according to yet another illustrative embodiment.
Figure 17:
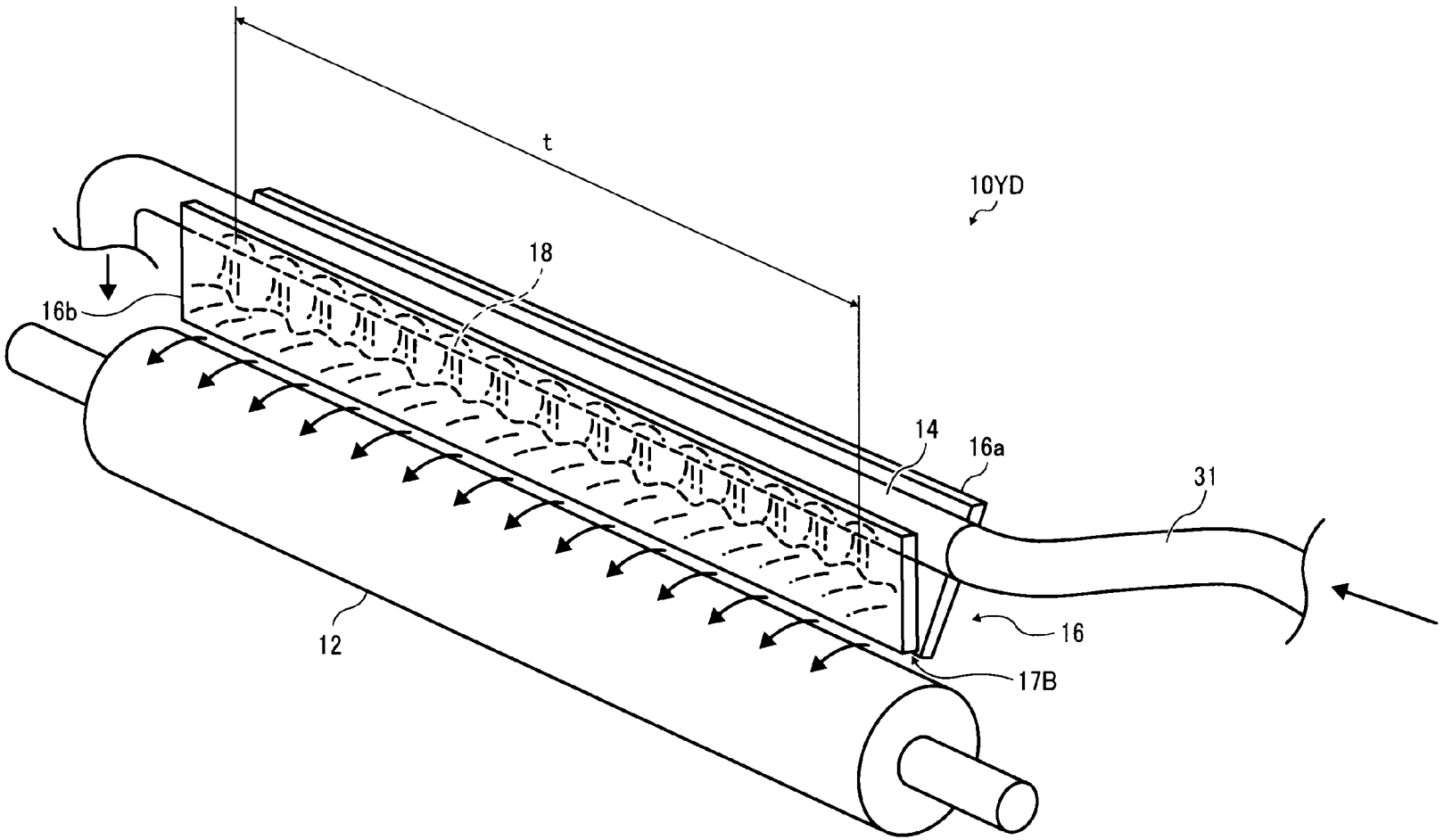
FIG. 17 is a perspective view of the development member shown in FIG. 16.
Figure 18:
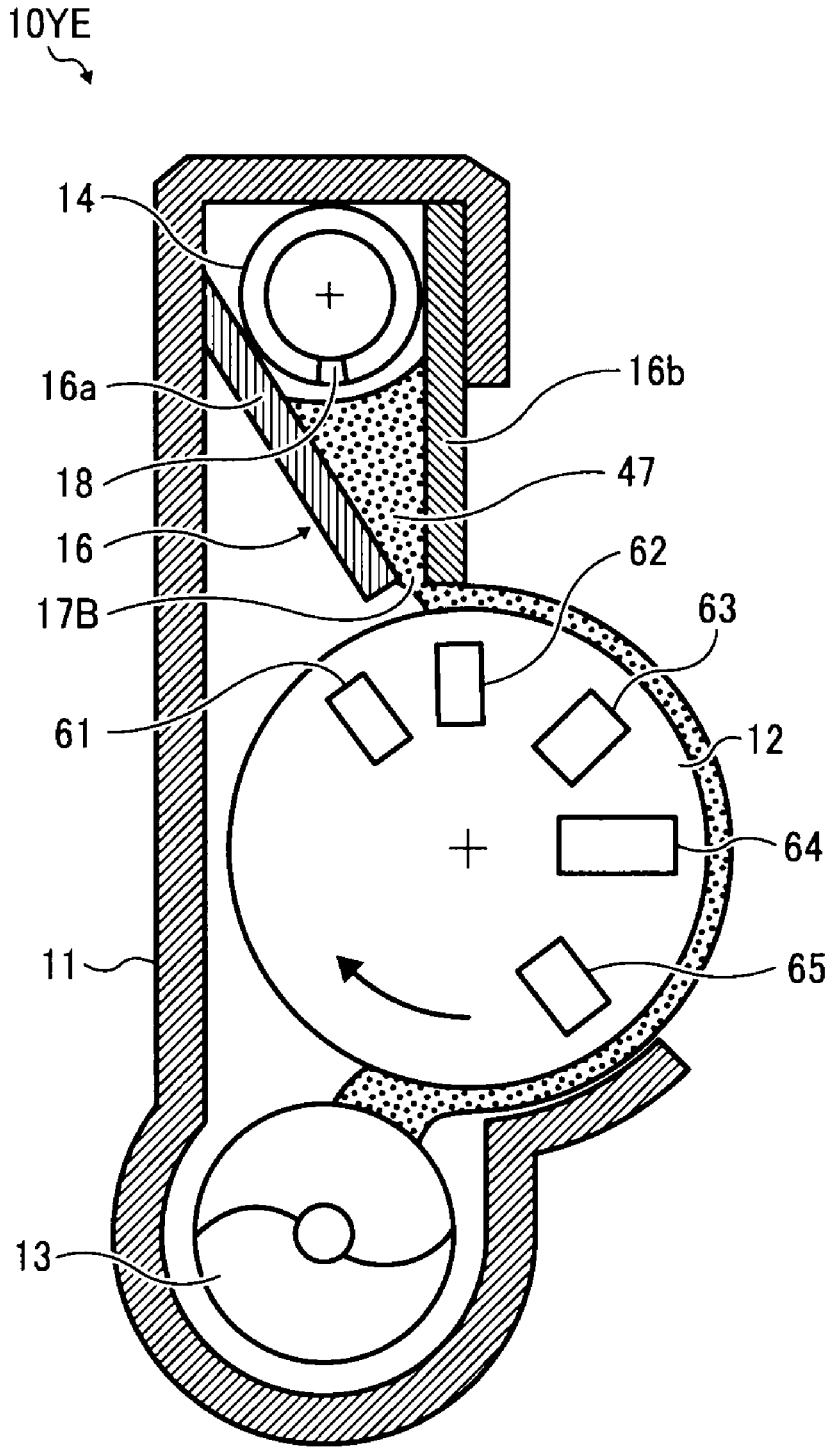
FIG. 18 is a schematic sectional view of a modification of the development member shown in FIG. 17.

Referring to FIGS. 16, 17, and 18, a description is now given of a development device 10YD according to another illustrative embodiment. FIG. 16 is a schematic sectional view of the development device 10YD.

The development device 10YB depicted in FIG. 9 uses a method of conveying developer by the flow of air. In such a method, since the amount of the developer conveyed from the developer agitation member 40Y to the development member 10Y varies in a short period of time, when a buffer of developer (puddle of developer) exists in the developer holder 16, a constant amount of the developer can be supplied to the development roller 12. However, when the buffer is empty, an appropriate amount of the developer cannot be supplied to the development roller 12.

Therefore, according to this illustrative embodiment, regardless of variation in the amount of developer supplied to the developer conveyer 14, due to provision of a buffer of developer in the developer holder 16, a constant amount of the developer can be supplied to the development roller 12. As a result, the doctor blade 15 need hardly control thickness of the developer supplied to the development roller 12, thereby reducing a stress on the developer, extending the useful life of the developer.

A specific structure of the development member 10YD is described in more detail. The whole structure of the development device 4Y is equivalent to that of the development device 4Y depicted in FIG. 2. The structures of the development roller 12 and the collection screw 13 are equivalent to those of the development roller 12 and the collection screw 13 of the development member 10Y depicted in FIG. 3.

The developer conveyer 14 is provided inside the developer conveyance path 31*a*, and conveys the developer in the longitudinal direction of the development roller 12. The developer conveyer 14 is connected to the developer agitation member 40 depicted in FIG. 2 via the developer transfer member 31 and the rotary feeder 50.

The developer conveyer 14 is provided substantially parallel to the development roller 12. The exit 18 (opening A) is provided in the developer conveyer 14 to discharge the developer to the development roller 12. The developer holder 16 is provided below the developer conveyer 14 to hold developer 47 discharged from the developer conveyer 14, and includes the developer outlet 17 (opening B) through which a predetermined amount of developer is supplied to the development roller 12. When supplied from the developer outlet 17, the developer 47 is carried by the development roller 12 and conveyed to a development area opposing the photoconductor 1Y depicted in FIG. 1 to be used for development of a latent image formed on the photoconductor 1Y.

As with the development member 10Y depicted in FIG. 3 or the development member 10YA depicted in FIG. 8, the developer used for development is collected by the collection path provided in the lower portion of the casing 11 and transferred to the developer agitation member 40Y depicted in FIG. 2 through the developer transfer member 30. When fresh toner stored in the toner container 20 is mixed and agitated with the developer returned to the developer agitation member 40Y, and dispersed and supplied with an electrical charge.

Referring again to FIG. 4, the developer agitation member 40Y includes the developer inlet 42, the developer outlet 43, and the toner supply inlet 44.

The agitator 46 is provided inside the developer agitation member 40, and driven to rotate by the motor 45 provided outside the developer agitation member 40Y. The plurality of agitation blades 41 is attached to the agitator 46, and agitates developer as rotation of the agitation blades 41.

The rotary feeder 50 discharges the developer from the developer agitation member 40, and includes the holder 53 and the rotor 52 including a plurality of blades. The airflow generator 60 is, for example, a blower or an air pump, and connected to the rotary feeder 50 via the tube 33 or the like to supply air to the rotary feeder 50. The rotary feeder 50 and the airflow generator 60 form a transfer member for supplying developer.

The developer container 20 stores toner inside thereof, and is made of metal, resin, or the like. The toner supply path 21 connects the toner container 20 with the developer agitation member 40Y. A coil screw is provided inside the toner supply path 21, and driven to rotate by the motor 28 to supply toner to the developer agitation member 40Y through the toner supply inlet 44 depicted in FIG. 4.

When the rotor 52 depicted in FIG. 4 of the rotary feeder 50 is driven to rotate by the motor 51, developer sequentially falls from the developer agitation member 40 to the inside of the rotor 52 due to its own weight and is discharged to the lower portion 54 of the rotary feeder SOY. The discharged developer together with the flow of air is conveyed to the development member 10YD depicted in FIG. 16 via the developer transfer member 31 depicted in FIG. 2 by air pressure generated by the air supplier, and transferred to the developer conveyance path 31*a* depicted in FIG. 3 of the development member 10Y connected to the developer transfer member 31.

According to this illustrative embodiment, the amount of developer or the lower limit of the amount of developer discharged from the developer conveyer 14 to the developer holder 16 is greater than the amount of developer carried by the development roller 12 and supplied to the development area. More specifically, the amount of developer supplied from the developer agitation member 40Y to the developer conveyer 14 through the developer transfer member 31 by the rotary feeder 50 is greater than the amount of developer carried by the development roller 12 and supplied to the development area.

The amount of developer supplied to the development area is the total amount of developer supplied to a whole surface of a sleeve of the development roller 12, and calculated by the following formula (1):

$$(\text{a width of the sleeve})\times(\text{a linear velocity of the sleeve})\times(\text{the amount of developer supplied per unit area})\times(\text{a measurement time}) \quad (1)$$

FIG. 17 is a schematic perspective view of the development member 10YD.

As illustrated in FIG. 16, the development member 10YD includes the development roller 12, serving as a developer carrier, being a nonmagnetic cylindrical development sleeve and a magnetic field generator provided inside the sleeve, for example, a magnetic roller attached with the plurality of magnetic poles 61, 62, 63, 64, and 65, or a plurality of magnets, and develops a latent image formed on the photoconductor 1Y into a toner image with toner included in the developer while holding the developer on a surface of the development roller 12 (the development sleeve). According to this illustrative embodiment, five magnetic poles 61, 62, 63, 64, and 65 are provided in the development roller 12. Alternatively, the development roller 12 may include four magnetic poles 62, 63, 64, and 65, as illustrated in FIG. 14.

As illustrated in FIG. 16, the doctor blade 15, serving as a developer controller, is provided in the upper portion of the opening of the casing 11, and controls thickness of the developer carried by the development roller 12. The developer outlet 17B of the developer holder 16 is provided such that the developer drops to the surface of the development roller 12 upstream from the doctor blade 15 in the direction of conveyance of the developer.

The doctor blade 15 controls the amount of developer adhering to the development roller 12 to maintain a predetermined amount of developer, and electrically charges toner by shearing the developer. It is to be noted that the development member 10YD may not include the doctor blade 15, as described later.

The developer conveyer 14 is a tubular member and includes the exit 18 (opening A) provided in the lower portion of the developer conveyer 14, and supplies developer to the development roller 12, so that the developer supplied from the developer transfer member 31 depicted in FIG. 2 into the developer conveyer 14 by the flow of air dropswards from the exit 18. The exit 18 of the developer conveyer 14 includes a series of circular holes.

The developer holder 16 is provided below the developer conveyer 14. The developer outlet 17B is provided in the lower portion of the developer holder 16, and preferably a slit-like opening having a predetermined width.

According to this illustrative embodiment, the development member 10YD includes two openings, that is, the exit 18 (opening A) and the outlet 17B (opening B), through which the developer flows down, thereby stably supplying the developer to the development roller 12.

Since the developer is conveyed in clusters by the flow of air, the amount of developer falling from the exit 18 (opening A) varies. However, according to this illustrative embodiment, due to provision of the developer holder 16, the developer 47 is once stored in a space inside the developer holder 16, and a predetermined amount of developer can be stably supplied from the developer outlet 17B (opening B) to the development roller 12.

When supplied to the development roller 12, the developer 47 passes the doctor blade 15, serving as a developer thickness controller, and is conveyed to the development area.

Control of the amount of buffer of the developer held by the developer holder 16 is described.

Although an average amount of the developer conveyed to the development roller 12 using the flow of air varies little, the amount of the developer used for one rotation of the development roller 12 in a short period of time (0 to a few seconds) varies. Therefore, in order to stably perform development, even when the amount of developer supplied from the developer agitation member 40Y to the development member 10Y varies, it is important to maintain a constant amount of developer supplied from the developer outlet 17 of the developer holder 16 to the development roller 12.

Figure 19:
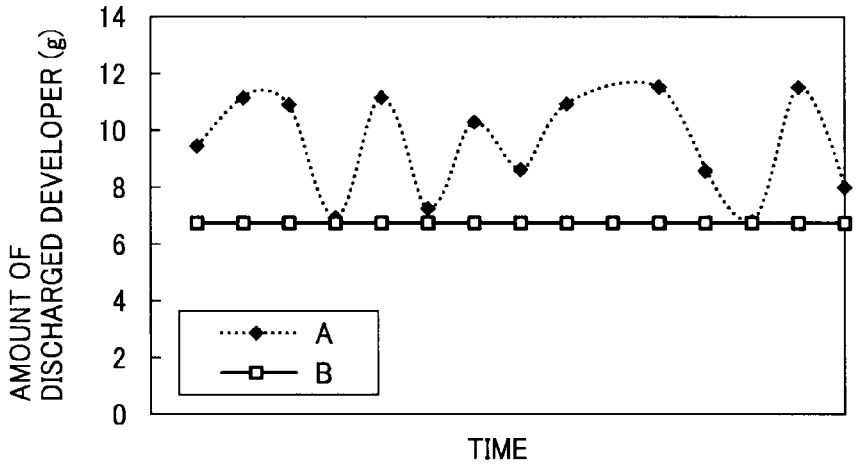
FIG. 19 is a graph illustrating a result of measurement of an amount of developer discharged from an opening of a developer conveyer and an amount of developer discharged from an opening of a developer holder included in the development member shown in FIG. 16.

FIG. 19 is a graph illustrating an amount of developer discharged from the opening A and an amount of developer discharged from the opening B. The graph shows that when the amount of developer discharged from the exit 18 (opening A) of the developer conveyer 14 is greater than the amount of developer discharged from the developer outlet 17 (opening B), a buffer of (the amount of developer discharged from the opening B)−(the amount of developer discharged from the opening A) is generated on the developer holder 16. When such buffer is constantly generated, a constant amount of developer is discharged from the developer outlet 17 (opening B).

As the amount of developer discharged from the exit 18 (opening A) is greater than the amount of developer discharged from the developer outlet 17 (the opening B), a greater amount of buffer of the developer 47 is accumulated on the developer holder 16, thereby stably supplying the developer to the development roller 12. However, a large space for storing the buffer is necessary. Moreover, an increase in the supply of developer increases an amount of energy required for conveyance. Therefore, the smaller the space for storing the buffer is, and the smaller the difference between the amount of developer discharged from the opening B and the amount of developer discharged from the opening A is, the more efficient the development member 10Y becomes.

By considering a relation between the amount of developer discharged from the exit 18 (opening A) of the developer conveyer 14 and the amount of developer discharged from the developer outlet 17 (the opening B), when the lower limit of the amount of developer discharged from the opening A obtained by averaging of intervals of developer movement time t in which the developer moves from the most upstream opening to the most downstream opening of the exit 18 (opening A) of the developer conveyer 14 is greater than the total amount of developer supplied to the whole surface of the sleeve of the development roller 12 (a width of the sleeve)×(a linear velocity of the sleeve)×(the amount of developer supplied per unit area), even though the amount of buffer increases or decreases, the buffer of developer does not become empty, thereby stably supplying the developer to the development roller 12.

It is to be noted that, based on the lower limit of the amount of developer discharged from the opening A by averaging of a time interval shorter than the developer movement time t, although the buffer of developer does not become empty, the stored buffer hardly decreases, so that a greater than necessary amount of developer is supplied to the development roller 12.

As an interval of measurement of the amount of developer discharged from the opening A increases, the difference between the average value and the lower limit declines. Therefore, the buffer may become empty, thereby causing the amount of developer supplied to the development roller 12 to fluctuate.

Referring to FIG. 18, a description is now given of a development member 10YE as another modification. FIG. 18 is a schematic sectional view of the development member 10YE.

A difference from the development member 10YD depicted in FIG. 16 is that the development member 10YE does not include the doctor blade 15 provided downstream from the position of supplying the developer to the development roller 12.

The amount of developer supplied to the development roller 12 is determined by the area of the developer outlet 17 (opening B). Therefore, the area of the opening B is determined so as to supply the amount of developer necessary for development. Then, the lower limit of the amount of developer discharged from the exit 18 (opening A) of the developer conveyer 14 averaged by the interval t is examined, and the torque of the rotary feeder 50 and the amount of air supplied by the airflow generator 60 are adjusted so as to be greater than the amount of developer discharged form the opening B.

Therefore, due to provision of the buffer, a constant amount of developer can be supplied from the developer outlet 17 (opening B) of the developer holder 16 to the development sleeve of the development roller 12.

In a conventional development device, developer in a compact state is created upstream of a doctor blade 15 and sheared by the doctor blade, thereby stably supplying the developer. However, the developer is subjected to stress when passing the doctor blade 50. According to this illustrative embodiment, since the development member 10YE does not include the doctor blade 15, no stress is put on the developer when the developer is conveyed on the development roller 12, thereby extending the useful life of the developer, as well as reducing the drive torque of the development roller 12.

Figure 20:
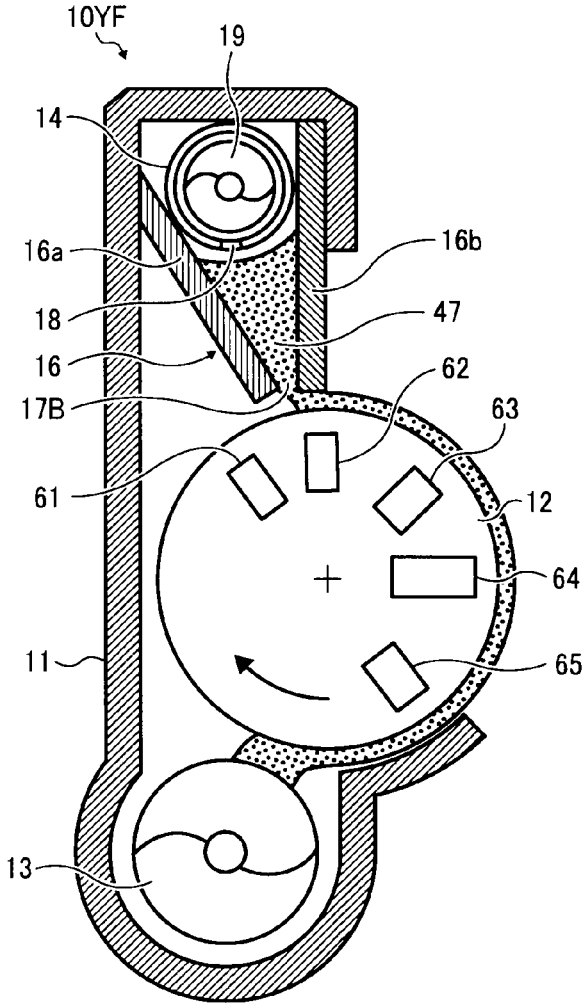
FIG. 20 is a schematic sectional view of yet another modification of the development member shown in FIG. 18.

Referring to FIG. 20, a description is now given of a development member 10YF as yet another modification. FIG. 20 is a schematic sectional view of the development member 10YF. The developer conveyer 14 further includes a developer feeder 19 provided inside the developer conveyer 14.

The developer feeder 19 is, for example, a screw, and provided substantially parallel to the development roller 12. The exit 18 (opening A) is provided below the developer feeder 19 to discharge the developer 47 to the development roller 12. The developer holder 16 includes the developer outlet 17 (opening B), and is provided below the exit 18 (opening A) to hold the developer 47 discharged from the exit 18 (opening A) and supply a predetermined amount of developer to the development roller 12.

According to this illustrative embodiment, the amount of developer conveyed by the developer feeder 19 and discharged from the exit 18 (opening A) to the developer holder 16 is greater than the amount of developer supplied to the development area of the development roller 12.

Moreover, according to this illustrative embodiment, in the development member 10YF, the developer is conveyed inside the developer conveyer 14 using the developer feeder 19 such as a screw, coil, or the like, without using the flow of air.

In the present embodiment, the developer conveyer 14 has a tubular shape. Alternatively, if a screw, or the like, can be provided inside the developer conveyer 14, the developer conveyer 14 may be semicircular, polygonal, or the like.

The rest of the structure of the development member 10YF is equivalent to that of the development member 10YE depicted in FIG. 18.

When the developer is conveyed from the developer agitation member 40 to the developer conveyer 14 through the developer transfer member 31, the developer feeder 19 conveys the developer. Then, when the developer partially drops through the exit 18 (opening A) to the developer holder 16 from the exit 18 (opening A) provided in the lower portion of the developer conveyer 14, a predetermined amount of developer is supplied from the developer outlet 17 (opening B) of the developer holder 16 to the sleeve of the development roller 12.

After development, the developer is collected by the collection screw 13 and transferred to the developer agitation member 40Y through the developer transfer member 30. Then, after mixed with toner, the developer is transferred to the development member 10YF through the developer transfer member 31 and supplied to the developer feeder 19 again.

Therefore, compared to using a flow of air, provision of the developer feeder 19 inside the developer conveyer 14 causes the developer to be stably supplied to the developer feeder 19. Moreover, although the pitch of the screw of the developer feeder 19 may cause uneven conveyance of the developer, by providing the developer holder 16 below the developer conveyer 14 the developer can be stably supplied to the development roller 12.

Alternatively, when fresh toner is directly supplied to the collection screw 13 of the development member 10YF, the developer does not need to be transferred to the developer agitation member 40. In this case, after the collection screw 13 mixes and agitates the toner and developer after development, the developer feeder 19 may circulate the toner and the developer.

Figure 21:
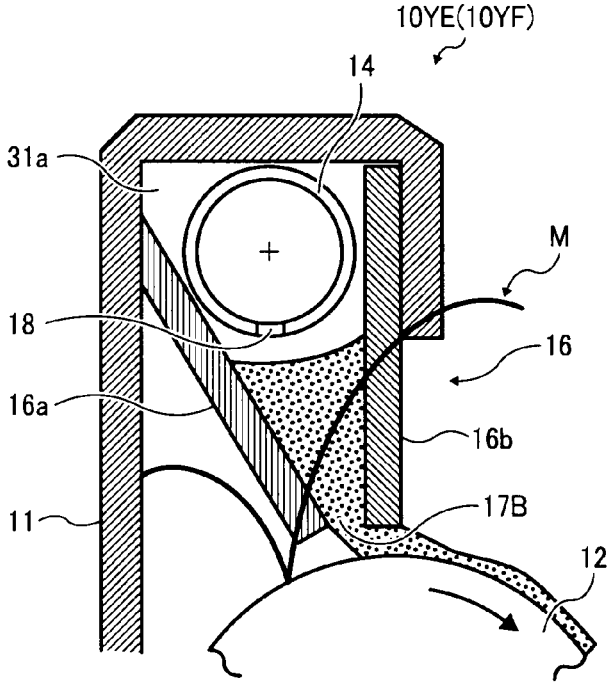
FIG. 21 is a partial sectional view of the development member shown in FIG. 18.

FIG. 21 is a partial sectional view of the development member 10YE (or 10YF). In order to supply the developer to the sleeve of the development roller 12, the developer outlet 17B (opening B) is a few millimeters separated from the sleeve of the development roller 12. According to this illustrative embodiment, the developer outlet 17B (opening B) of the developer holder 16 is provided in a position with a positive magnetic flux density in a normal direction.

Therefore, the developer discharged from the developer outlet 17B (opening B), that is, the developer existing between the opening B and the sleeve, is held by the sleeve due to the magnetic force of the development roller 12. Thus, no developer drops from a gap between the opening B and the sleeve, merely a small amount of developer is supplied to the sleeve of the development roller 12.

When supplied to the sleeve of the development roller 12, the developer is conveyed with the rotation of the sleeve of the development roller 12 and reaches the development area. As the sleeve rotates, a gap is generated between the developer outlet 17B (opening B) and the sleeve to allow the developer to drop from the developer outlet 17B (opening B). Repetition of such movement causes the developer to be stably supplied to the development roller 12.

Figure 22:
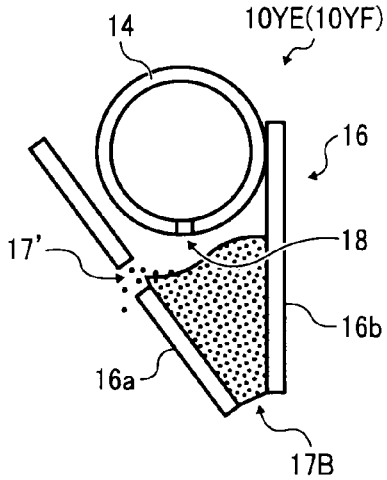
FIG. 22 is a partial sectional view of a modification of the developer holder of the development member shown in FIG. 20.

FIG. 22 illustrates a modification of the developer holder 16 of the development member 10YE (or 10YF). The developer holder 16 includes a second developer outlet 17' (opening C) provided above the developer outlet 17B (opening B) and below the exit 18 (opening A) of the developer conveyer 14.

Due to provision of the second developer outlet 17' (opening C), even when the developer accumulates in a gap between the developer holder 16 and the developer conveyer 14, the developer can still drop from the second outlet 17' (opening C). When the opening C is not provided, the developer may remain in the developer conveyer 14, thereby disturbing conveyance of the developer inside the developer conveyer 14.

Referring to FIGS. 23A and 23B, a description is given of the relative positions of the exit 18 (opening A) and the developer outlet 17B (opening B). FIG. 23A illustrates a development member 10YE' (10YF') in which the opening A and the opening B are vertically arranged, and FIG. 23B illustrates a positional relation therebetween of this embodiment.

As illustrated in FIG. 23A, after discharged from an exit 18' (opening A) of a developer conveyer 14', the developer directly falls to a developer outlet 17B' (opening B) of a developer holder 16'. Therefore, as the developer falls from the opening A with great force, the developer accumulated as a buffer is pushed out of the developer holder 16' from the opening B'. Unless a constant amount of developer is discharged from the opening A, since the ratio of developer to air fluctuates, the rate at which the developer is discharged from the opening A varies, so that the amount of developer discharged from the opening B varies.

Therefore, as illustrated in FIG. 23B, the exit 18 (opening A) and the developer outlet 17B (opening B) are not vertically aligned. Therefore, after discharged from the opening A, the developer drops to the developer holder 16 and moves along the inclined wall 16*a* of the developer holder 16. Thus, even when the rate of the developer discharge from the exit 18 (opening A) of the developer conveyer 14 varies, the variation in the rate is reduced when the developer hits against the wall 16*a* of the developer holder 16. In addition, since the developer is supplied obliquely downwards to the opening B, not from directly above the opening B, the developer outlet 17B (opening B) is hardly clogged with the developer.

A description is now given of a shape of the exit 18 (opening A) of the developer conveyer 14. Since the development member 10YD depicted in FIG. 16 does not use a screw for supplying developer to the sleeve of the development roller 12 the developer is unevenly supplied to the development roller 12 depending on the shapes of the opening A and the opening B. (Although the development member 10YF depicted in FIG. 20 includes the screw provided inside the developer conveyer 14, merely the buffer of developer exists in the developer holder 16 provided between the developer conveyer 14 and the development roller 12, and no screw is provided.)

As illustrated in FIG. 17, since the exit 18 (opening A) of the developer conveyer 14 is perforated in the axial direction of the development roller 12, the area of the opening determines the amount of developer discharged from the opening A. When a distance between each opening A is large, a uniform buffer layer cannot be generated, the developer cannot be uniformly supplied to the sleeve of the development roller 12.

Thus, according to this illustrative embodiment, the distance between each opening A is smaller than half of a width of the developer falling from one opening A and reaching the developer outlet 17 (opening B) of the developer holder 16.

Although the maximum distance between each opening A differs depending on a distance from the sleeve and an angle of the wall 16*a* of the developer holder 16, the distance between each opening A is obtained by the following experiment.

Figure 26:
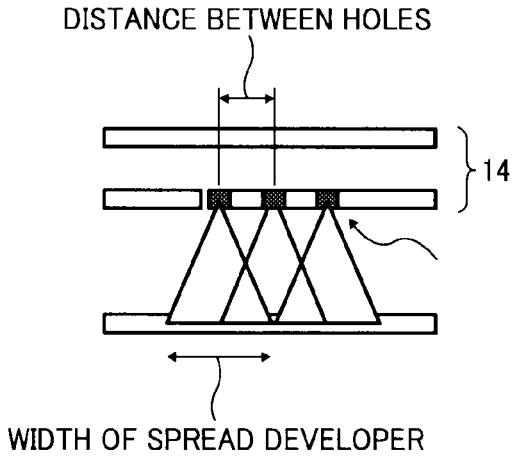
FIG. 26 is a schematic sectional view of the developer conveyer illustrating a distance between each hole of the developer conveyer shown in FIG. 23B.

Referring to FIGS. 24, 25, and 26, a description is now given of an experiment of measuring a distance between each hole of the opening A. FIG. 24 illustrates an experiment for obtaining a distance between each opening of the developer conveyer 14. When a plate having an opening (hole) was prepared, developer fell through the hole onto a surface inclined at an angle $\alpha$ of the wall 16*a* of the developer holder 16. When the developer fell down along the inclined surface of the wall 16*a*, a distance of the fallen developer and a width of the developer spreading out on the wall 16*a* were measured.

This experiment found that the distance between each hole of the opening A is smaller than or equal to the width of the spread developer.

FIG. 25 is a table of widths of spread developer falling though a hole with a diameter of 2 mm on a plate in the experiment of FIG. 24. The table shows that the widths of the spread developer differ according to a distance from the sleeve of the development roller 12 and an angle $\alpha$ of the wall 16*a* of the developer holder 16.

FIG. 26 illustrates a distance between each hole of the exit 18 (opening A) of the developer conveyer 14. When the distance between each hole of the exit 18 (opening A) is half the spreading width of the developer, the developer discharged from adjacent holes of the opening A overlaps each other, thereby forming a constant amount of buffer. Therefore, the developer is stably discharged from the developer outlet 17 (opening B), thereby being stably supplied to the development roller 12.

Figure 27:
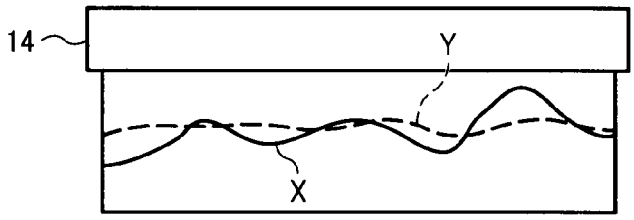
FIG. 27 is an illustration of surfaces of a buffer formed on the developer holder.
Figure 28:
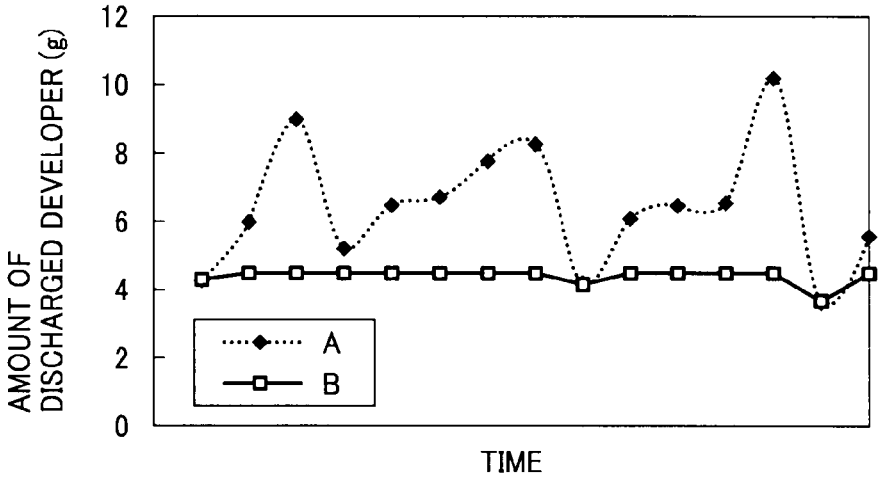
FIG. 28 is a graph illustrating a result of measurement of an amount of developer discharged from the opening of the developer conveyer and an amount of developer discharged from the opening of the developer holder under different conditions from the measurement shown in FIG. 19.

Referring to FIGS. 19, 27, and 28, a description is now given of experiments and comparison experiments using the development member 10YD depicted in FIG. 16 and the development member 10YE depicted in FIG. 18.

In the development member 10YD and the development member 10YE, the developer is conveyed to the developer conveyer 14 using air pressure generated by the airflow generator 60 such as an air pump, or the like. Thus, when the developer moves through the developer conveyer 14 and passes through the exit 18 (opening A), not only the developer but also the air pass through the opening A, thereby rapidly reducing pressure for conveyance inside the developer conveyer 14. Therefore, the developer is conveyed inside the developer conveyer 14 not by air pressure, but by inertial force to move the developer in a direction of movement when the developer enters the developer conveyer 14.

However, if the rate of the developer movement inside the developer conveyer 14 using the inertial force is zero, the developer may not be further conveyed in a downstream direction. Then, when the buffer on the developer holder 16 is empty, the developer is not sufficiently supplied to the sleeve of the development roller 12.

Therefore, in the development member 10YD and the development member 10YE, developer conveyance air is supplied from the exit 18 (opening A) of the developer conveyer 14 to the inside of the developer conveyer 14 such that the rate of movement of the developer in the direction of movement of the developer is greater than zero, so that the rate of horizontal movement of the developer at the exit 18 (opening A) of the developer conveyer 14 is preferably greater than zero.

To be specific, the amount of air supplied by the airflow generator 60 such as an air pump, or the like, depicted in FIG.

2 or FIG. 4 can be increased. Alternatively, another air pump may be provided substantially upstream of the developer conveyer 14 to effectively supply air used only for conveyance of the developer inside the developer conveyer 14.

A first experiment using the development member 10YD was performed under the following conditions.

Developer conveyer 14 with an inner diameter of 9 mm and a length of 310 mm

Opening A with a diameter of 2 mm and a distance between holes of from 5 mm to 14 mm Opening B of the developer holder 16 with a slit width of 1.5 mm and a length of 300 mm Developer transfer member 31 with an inner diameter of 8 mm, a length of 300 mm, and a lifting range of 80 mm Air pump with the amount of air supply of 4 L/min Rotary feeder 50 with an average amount of developer discharged of 30 g/s Developer 47 including carrier with a length of 35 μm and toner with a length of 6 μm; toner density of 7 wt %

Development roller 12 including the sleeve with a linear velocity of 150 mm/s, the amount of developer necessary for development 50 mg/cm$^2$, and a magnetic width of 300 mm Under the above conditions, the amount of developer to be supplied to the whole surface of the sleeve of the development roller 12 was calculated by the following formula (2):

$$300\ \text{mm} \times 150\ \text{mm/s} \times 50\ \text{mg/cm}^2 = 22.5\ \text{g/s} \quad (2)$$

The movement time t in which the developer passes through the developer conveyer 14 was 0.3 s.

The graph of FIG. 19 shows a result of measurement of the amount of developer discharged from the exit 18 (opening A) of the developer conveyer 14 at intervals of 0.3 seconds. An average amount of the developer was 10 g, and the lowest amount of the developer was 6.8 g. The amount of developer supplied to the development roller 12 after passing the doctor blade 15 was 50 mg/cm$^2$, and the amount of developer conveyed to the development area in 0.3 seconds was 6.75 g. Therefore, the lowest amount of the developer discharged from the opening A of the developer conveyer 14 is greater than the amount of the developer supplied to the development area. As a result, the buffer exists on the developer holder 16, so that a constant amount of developer is stably supplied to the development roller 12.

Dynamic torque of the development roller 12 was 0.88 kg·cm.

A second experiment was performed using the development member 10YE depicted in FIG. 18 without including the doctor blade 15. A distance between the developer outlet 17 (opening B) of the developer holder 16 and the sleeve of the development roller 12 was 1 mm, and the magnetic flux density in a normal direction was 10 mT. The other conditions were equivalent to those of the first experiment.

The amount of developer discharged from the opening B was 6.75 g in 0.3 seconds. All the developer discharged from the opening B was conveyed to the development area without falling to the opposite side of the development area. The amount of developer supplied to the development area opposing the photoconductor 1Y was 50 mg/cm$^2$.

The buffer exists on the developer holder 16, so that a constant amount of developer is stably supplied to the development roller 12.

Dynamic torque of the development roller 12 was 0.75 kg·cm. Therefore, compared to the above experiment, deterioration of the developer (decrease in fluidity) with respect to the number of printed sheets is reduced.

A third experiment was performed using the development member 10YD under the same conditions of the first experiment except that the maximum distance between holes of the exit 18 (opening A) of the developer conveyer 14 was 10 mm. After discharge from the opening A, the width of the developer spread in a lateral direction when reaching the developer outlet 17 (opening B) of the developer holder 16 was about 20 mm. Thus, the distance between each hole is smaller than or equal to half the width of the developer falling from the opening A.

FIG. 27 illustrates surfaces of the buffer on the developer holder 16 in the first and the third experiments. Broken line Y representing the surface of the buffer in the third experiment is smoother than solid line X representing the surface of the buffer in the first experiment.

In addition, after discharged from the developer outlet 17 (opening B) of the developer holder 16*a*, the amount of the developer supplied to the development roller 12 in the axial direction of the development roller 12 varies little.

A comparison experiment was performed using the development member 10YD under the condition that the flow rate of the airflow generator 60 is 6 L/min. The other conditions were the same as those of the first experiment.

In this experiment, a time t required for the developer to move through the developer conveyer 14 was 0.2 seconds.

FIG. 28 is a graph illustrating an amount of developer discharged from the opening A and an amount of developer discharged from the opening B at intervals of 0.2 seconds. The average amount of developer discharged from the opening A was 6 g, and the lowest amount was 3.6 g. The amount of developer discharged from the opening B was almost 4.5 g. When the amount was close to the lowest amount, a buffer is not partially formed on the developer holder 16, so that the developer is unevenly supplied to the sleeve of the development roller 12.

As a result of the above experiments, advantageous effects of the development device 4Y are confirmed.

As can be appreciated by those skilled in the art, although the present invention has been described above with reference to specific exemplary embodiments the present invention is not limited to the specific embodiments described above, and various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A development device, comprising:

a developer carrier to carry and convey developer having a magnetic property, the developer carrier comprising a plurality of magnetic poles provided inside the development carrier; and a developer conveyance path provided above the developer carrier to convey the developer by a flow of air such that the developer is conveyed parallel to the developer carrier, the developer conveyance path provided with a first developer outlet disposed above the developer carrier and open along a direction of conveyance of the developer to discharge the developer to the outside of the developer conveyance path to directly supply the developer to the developer carrier.

2. The development device according to claim 1, further comprising:

a developer controller to regulate a thickness of the developer carried by the developer carrier, wherein the first developer outlet is provided upstream from the developer controller in the direction of conveyance of the developer on a surface of the developer carrier to cause the developer to be discharged in the vicinity of the developer controller.

3. The development device according to claim 1, wherein the developer is supplied to the developer carrier by frictional force at locations on a surface of the developer carrier that correspond to spaces between adjacent magnetic poles of the plurality of magnetic poles.

4. The development device according to claim 1, wherein a filter that discharges air to the outside of the development device is provided in the developer conveyance path.

5. The development device according to claim 1, wherein the developer conveyance path further comprises:

a developer conveyer to convey the developer in a longitudinal direction of the developer carrier, the developer conveyer comprising an exit to discharge the developer from the developer conveyer; and a developer holder to receive and hold the developer discharged from the exit of the developer conveyer, wherein the first developer outlet is located in the developer holder.

6. The development device according to claim 5, wherein the developer holder comprises:

two opposing walls provided below the developer conveyer; and a slit-like opening provided in lower portions of the two opposing walls.

7. The development device according to claim 6, wherein an inclination angle of the walls with respect to a horizontal plane is greater than or equal to a repose angle of the developer.

8. The development device according to claim 5, wherein the developer conveyer is provided substantially parallel to the developer carrier, and a minimum amount of developer to be supplied to the developer conveyer is such that an amount of developer discharged from the developer conveyer to the developer holder is greater than an amount of developer to be supplied to a development area.

9. The development device according to claim 8, wherein a second developer outlet of the developer holder is provided in a position with a positive magnetic flux density in a normal direction.

10. The development device according to claim 8, wherein the second developer outlet of the developer holder is provided above the first developer outlet and below the exit of the developer conveyer.

11. The development device according to claim 8, wherein the exit of the developer conveyer and the second developer outlet of the developer holder are not vertically aligned.

12. The development device according to claim 8, wherein the exit of the developer conveyer is perforated with holes separated from each other in the axial direction of the developer carrier, and a distance between each hole is smaller than half a spreading width of the developer when the developer is discharged from one opening and reaches the exit of the developer conveyer.

13. The development device according to claim 8, wherein air is supplied to the inside of the developer conveyer to convey the developer such that a movement rate of the developer measured at the exit of the developer conveyer is greater than zero.

14. The development device according to claim 5, wherein the developer conveyer is provided substantially parallel to the developer carrier, and an amount of developer to be supplied to the developer conveyer is such that an amount of developer discharged from the developer conveyer to the developer holder is greater than an amount of developer to be supplied to a development area.

15. The development device according to claim 8, wherein the amount of developer conveyed to the development area is determined based on the area of the opening of the first developer outlet of the developer holder.

16. The development device according to claim 5, wherein the developer conveyer comprises a developer feeder provided inside the developer conveyer.

17. The development device according to claim 1, further comprising:

a development member comprising the developer carrier; the developer conveyance path; and a collection path to collect the developer supplied to the developer carrier, wherein the developer circulates through the development member and the developer agitation member;

a developer agitation member provided separately from the development member to store and agitate two-component developer including toner and magnetic carrier;

a first developer transfer member to supply the developer from the developer agitation member to the development member; and a second developer transfer member to transfer the developer collected by the collection path of the development member back to the developer agitation member.

18. The development device according to claim 17, further comprising an airflow generator to generate airflow, wherein at least the first transfer member supplies the developer to the development member by the airflow.

19. The development device according to claim 17, further comprising:

a toner container to store toner; and a toner transfer member to supply the toner from the toner container to the developer agitation member.

20. An image forming apparatus, comprising:

a latent image forming device to form an electrostatic latent image, the latent image forming device comprising:

an image carrier to carry the electrostatic latent image; and a development device to develop the electrostatic latent image into a visible image, the development device comprising:

a developer carrier to carry and convey developer having a magnetic property, the developer carrier comprising a plurality of magnetic poles provided inside the development carrier; and a developer conveyance path provided above the developer carrier to convey the developer by a flow of air such that the developer is conveyed parallel to the developer carrier, the developer conveyance path provided with a first developer outlet disposed above the developer carrier and open along a direction of conveyance of the developer to discharge the developer to the outside of the developer conveyance path to directly supply the developer to the developer carrier.

* * * * *